United States Patent [19]

Saitou et al.

[11] Patent Number: 4,977,074

[45] Date of Patent: Dec. 11, 1990

[54] SILVER HALIDE EMULSION COMPRISING SUBSTANTIALLY CIRCULAR MONODISPERSE TABULAR SILVER HALIDE GRAINS AND PHOTOGRAPHIC MATERIAL USING THE SAME

[75] Inventors: Mitsuo Saitou; Yoichi Suga, both of Kanagawa, Japan

[73] Assignee: Fuji Photo Film Co., Ltd., Kanagawa, Japan

[21] Appl. No.: 233,110

[22] Filed: Aug. 17, 1988

[30] Foreign Application Priority Data

Aug. 17, 1987 [JP] Japan ..... 62-203635

[51] Int. Cl.[5] ..... G03C 1/02

[52] U.S. Cl. ..... 430/567; 430/569

[58] Field of Search ..... 430/567, 569

[56] References Cited

U.S. PATENT DOCUMENTS 4,713,323 12/1987 Maskasky ..... 430/569

4,797,354 ·1/1989 Saitou et al. ..... 430/567

FOREIGN PATENT DOCUMENTS 0099433 6/1984 Japan ..... 430/567

3052130 3/1988 Japan ..... 430/567

*Primary Examiner*—Paul R. Michl

*Assistant Examiner*—Thomas R. Neville

*Attorney, Agent, or Firm*—Sughrue, Mion, Zinn, Macpeak & Seas

[57] ABSTRACT

A silver halide emulsion comprising a binder and silver halide grains, wherein the projected area of substantially circular tabular silver halide grains having two parallel twin planes to the basal planes having a linear ratio of 0 to 4/5 accounts for from 70% to 100% of the projected area of the whole silver halide grains, and further the circular tabular silver halide grains are monodisperse grains.

The emulsion has good aging stability.

17 Claims, 5 Drawing Sheets

SILVER HALIDE EMULSION COMPRISING SUBSTANTIALLY CIRCULAR MONODISPERSE TABULAR SILVER HALIDE GRAINS AND PHOTOGRAPHIC MATERIAL USING THE SAME

FIELD OF THE INVENTION

The present invention relates to a silver halide emulsion and photographic material useful in the field of photography, and more particularly to a silver halide emulsion comprising a binder and tabular silver halide grains.

BACKGROUND OF THE INVENTION

Tabular silver halide grains having a parallel twin plane (which hereinafter are referred to as "tabular grains") have the following photographic properties:

(1) The ratio of the surface area to the volume (hereinafter, the ratio is referred to as "specific surface area") of the tabular grains is large and a large amount of sensitizing dye(s) can be adsorbed onto the surface, whereby the spectral sensitivity is relatively higher than the inherent sensitivity thereof.

(2) When a silver halide emulsion containing the tabular grains is coated and dried, the grains are disposed in parallel to the surface of the support, whereby the thickness of the coated emulsion layer can be thinned to improve the sharpness of images.

(3) In an X-ray photographic system, by adding sensitizing dye(s) to tabular grain silver halide emulsions, the amount of crossover light can be remarkably reduced, since the extinction coefficient of the dye(s) is larger than the extinction coefficient by the indirect transition of the silver halide (AgX), whereby the degradation of image qualities can be prevented.

(4) The silver halide emulsion containing the tabular grains causes less scattering of light and hence can give images having high resolution.

(5) Since the specific surface area is large, the developing rate is high.

Owing to these various advantages, the tabular grain silver halide emulsions have hitherto been used for high speed photographic materials on market.

Tabular grains, of silver halide emulsions, having an aspect ratio of at least 8 (i.e., at least 8/1) are disclosed in JP-A-58-113926, JP-A-58-113927, JP-A-58-113928 (the term "JP-A" as used herein refers to a "published unexamined Japanese patent application"), etc.

The term "aspect ratio" is the ratio of the diameter of the tabular grain to the thickness thereof, and is expressed herein as ratio of two numbers (if omitted, the second number is considered as being 1). Furthermore, the "diameter" of the grain is defined as the diameter of a circle having an area equal to the projected area of the grain as viewed in a micrograph or an electron micrograph of an emulsion. Also, the thickness of the grain is shown by the distance between two basal planes constituting the tabular grain.

However, as shown in the examples of the aforesaid patent, the tabular grains prepared by the conventional process show poor monodispersibility and hence have disadvantages such as that:

(1) the increase of contrast (i.e., high gamma) of the characteristic curve cannot be expected, and (2) when the emulsion containing the large silver halide grains and the small silver halide grains is chemically sensitized, it is difficult to apply the optimum chemical sensitization to both of the silver halide grains, because the optimum condition for the chemical sensitization differs between the large grains and the small grains.

Accordingly, various attempts for improving the monodispersibility of tabular grains have hitherto been proposed.

In the monodisperse tabular grains disclosed in JP-A-52-153428 and U.S. Pat. Nos. 4,150,994, 4,184,877 and 4,184,878, there is a restriction of using AgI crystals as the nuclei and the content of the substantially circular tabular silver halide grains having two parallel twin planes, in the present invention (which grains are tabular grains having two parallel twin planes which are parallel also to the basal plane in one grain, and hereinafter are referred to as "circular tabular grains") in the grains obtained is less.

JP-A-142329 and U.S. Pat. No. 4,301,241 disclose the growing condition for monodisperse tabular grains, but since the nucleus forming condition for seed crystals used in the example was improper, the tabular grains formed contained less tabular grains having two parallel twin planes than in the case of the present invention.

JP-A-61-112142 discloses monodisperse twin grains, but since spherical grains are used as the seed crystals, the aspect ratio of the silver halide grains obtained in the examples thereof is up to 2.2, which is a low aspect ratio. Further, JP-A-61-112142 does not mention the control of supersaturation upon forming nuclei for the monodisperse twin grains.

JP-A-51-39027 discloses the same grain-forming process as the patent publication described above. However, the tabular grains in this patent literature contain no substantially the circular tabular grains.

Monodisperse circular tabular grains described in the examples of French Patent No. 2534036 show that at least 50% of the projected area are the one originating from the trigonal tabular grains according to the grain photograph shown there. As stated in J. E. Maskasky, *Journal of Image Science,* vol. 31, p.15–26, (1987), each of the trigonal tabular grains has triple parallel twin planes, which are different from the grains according to the present invention.

Since the twin planes are two dimensional defects which break the periodic lattice of crystals there, they hinder the transfer of photoelectrons or trap electrons and therefore increase the internal sensitivity. Accordingly, while it is necessary that a grain has two parallel twin planes for preparing the tabular grain, three or more twin planes are disadvantageous since the synergism effect with the increase of the number of planes increases the internal traps, makes the internal sensitivity higher and promotes the dispersion of latent images.

Accordingly, tabular grains as described above having three parallel twin planes per grain are not desirable since their characteristics are inferior to tabular grains having two parallel twin planes.

Japanese Patent Application No. 61-48950 of the present inventor et al., discloses a method of preparing monodisperse tabular grains.

Japanese Patent Application No. 61-299155 of the present inventor et al discloses monodispersed hexagonal tabular silver halide grains, and claims the grain form which is obtained mainly by the hexagonal edge dissolution of the monodisperse hexagonal tabular grains. Since, these hexagonal tabular grains have sharp edges, they involve the following problems: (1) The edge portions of the tabular grains having sharp edges are easily soluble and tend to be rounded with the lapse of time. That is, they tend to be rounded during the step of water washing or re-dispersion, during chemical ripening, etc. This change is remarkable, particularly in tabular grains of high aspect ratio or tabular grains of small size.

Although the aging deformation of the tabular grains can be prevented to some extent by previously adding additives such as sensitizing dyes and adsorbing them to the grains after the formation of the grains, it still remains as a problem. Particularly, when the chemically sensitized tabular grains are dissolved in the subsequent steps, it is not desirable since the chemically sensitized nuclei on the dissolvable portion are also affected together.

(2) For preparing silver halide grains of high sensitivity, it is usually necessary to restrict the position of the chemically sensitized nuclei in order to prevent the dispersion of latent images. In this case, a method is known of adsorbing additives preferentially adsorbed to the main surface of silver halide grains (for example, sensitizing dyes, anti-fogging agents or stabilizers alone or in admixture) and then adding a chemical sensitizer, thereby forming chemically sensitized nuclei in a portion not adsorbed by the additives. However, in the case of tabular grains, since both of the parallel main plane surfaces and the outer surfaces of the edge portions are (111) planes, it is difficult to prepare the chemically sensitized nuclei limited to the planes of the plane index different from each other, as stated in J. F. Hamilton and L. E. Braddy, *Journal of Applied Physics*, vol. 35, pp. 414–421 (1964).

Accordingly, tabular silver halide grains showing satisfactory monodispersibility, having two parallel twin planes, showing good aging stability and in which the position for the chemically sensitized nuclei is restricted (and accordingly, dispersion of latent images is inhibited) are desired as photographic silver halide grains.

SUMMARY OF THE INVENTION

An object of the present invention is to provide a negative type silver halide photographic emulsion of uniform configuration, having good monodispersibility.

Another object is to provide an emulsion with desirable aging stability.

A further object is to provide such an emulsion with good chemical sensitization properties.

Yet another object is to provide an emulsion with good sensitivity, gradation, graininess, sharpness, resolution power, covering power, image quality and pressure property.

A yet further object is to provide a light-sensitive material using such a photographic emulsion.

It has now been discovered that these and other objects of the present invention can be attained by a silver halide emulsion comprising a binder and silver halide grains, wherein at least 70% of the total projected area of the whole silver halide grains being tabular silver halide grains having two parallel twin planes to the basal plane, the basal plane being substantially circular and having a linear ratio of at most 4/5, the tabular silver halide grains having monodisperse size distribution.

DESCRIPTION OF THE ACCOMPANYING DRAWINGS

FIG. 1 (*a*) is a schematic top view of a substantially circular tabular silver halide grain according to the present invention, showing the rounding of corners of a hexagonal shape;

FIG. 1 (*b*) s a schematic side view of a substantially circular tabular silver halide grain according to the present invention, showing the forming of chemically sensitized nuclei on the edge portions of the grain.

FIG. 2 and FIG. 3 are electron microscope photographs of the silver halide crystal grains in a silver halide emulsion prepared in Example 1 at magnifications of 2,500 (FIG. 2) and 2,100 (FIG. 3);

FIGS. 4 through 6 are electron microscope photographs of silver halide crystal grains in the silver halide emulsion according to the present invention prepared in Examples 2 through 4, at magnifications of 2,200 (FIG. 4), 1,200 (FIG. 5) and 4,100 (FIG. 6);

FIGS. 7 (*a*) through 7 (*d*) show respective regions in which substantially circular tabular grains according to Example 5 are obtained. In the drawings, the abscissa represents the pBr value, while the ordinate represents the concentration of the silver halide solvent. FIG. 7 (*a*) and FIG. 7 (*c*) show the case where thioether is used, FIG. 7 (*b*) and FIG. 7 (*d*) show the case where ammonia is used. FIG. 7 (*a*) and FIG. 7 (*b*) show the case of small circular tabular grains having the mean grain size of 0.58 μm, while FIG. 7 (*c*) and FIG. 7 (*d*) show the case of large circular tabular grains having the mean grain size of 1.40 μm.

The hatched portions in each of the drawings represent effective regions for the production of the substantially circular tabular grains.

DETAILED DESCRIPTION OF THE INVENTION

Figure 1A:
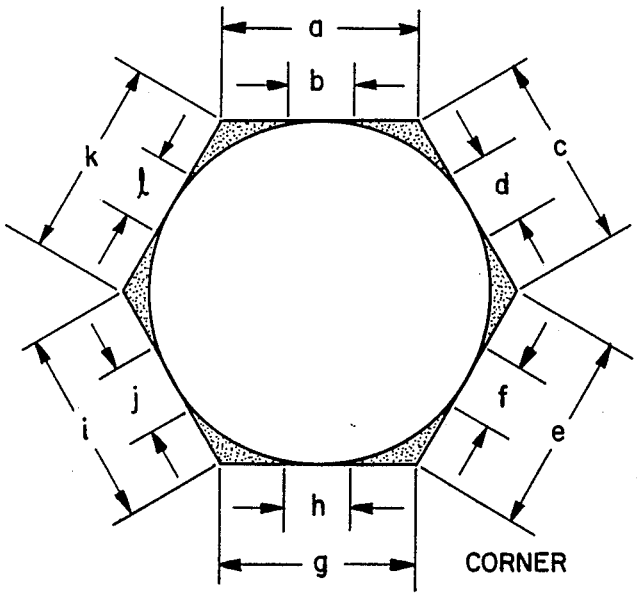

The monodispersibility in the present invention is shown by the coefficient of variation, i.e., the value obtained by dividing a dispersion (standard deviation) of grain sizes shown by the diameters of the circles having areas equal to the projected areas by the average grain size thereof.

The grain size distribution of a silver halide emulsion composed of light-sensitive silver halide grains having a uniform grain shape and a small dispersion of grain sizes show a nearly normal distribution and the standard deviation thereof can be easily obtained. The grain distribution of the monodisperse silver halide grains in the present invention has a coefficient of variation of the sizes of at most 35%, preferably at most 30%, more preferably at most 20%, most preferably at most 15%.

The substantially circular tabular grains in the present invention include those grains in which the shape of the (111) basal planes is substantially circular, and which have two parallel twin planes to the basal plane, and the average aspect ratio is not less than 2.5, preferably, from 2.5 to 20 and, more preferably from 4 to 16. The average grain size is not less than 0.2 μm and preferably, from 0.2 μm to 5 μm.

The term "average aspect ratio" means the average value of the aspect ratio of the all substantially circular tabular grains present in the emulsion whose aspect ratio is not less than 2.5.

Generally, the shape of the (111) basal planes of tabular grains having two parallel twin planes is hexagonal, with the maximum adjacent side ratio of about 2-1 as described in Japanese Patent Application No. 61-299155, and the substantially circular tabular grains according to the present invention have a shape in which the corners of the hexagonal shape are rounded.

The term "adjacent side ratio" as used herein means the ratio of the maximum side length to the minimum side length forming the hexagonal shape.

Although the basal planes of the circular tabular grains according to the present invention are circular, it need not be a completely circular shape. That is, it may partially include linear portions. The ratio of the linear portion (herein referred to as the "linear ratio") therein is preferably 4/5-0 of the side length of the hexagonal tabular shape with the adjacent side ratio being 2-1 (hereinafter referred to as "not more than 4/5 linear ratio").

When the corner has roundness to some extent, the length of the side is shown by the distance between the cross point of the extended straight line portion of the side and the extended straight line portion of one adjacent side and the cross point of the extended straight line portion of the aforesaid side and the extended straight line portion of another adjacent side. Quite circular grains with no linear portions at all (that is, the linear ratio 0) can of course be used. The preferred linear ratio is from ½ to 0.

Figure 1B:
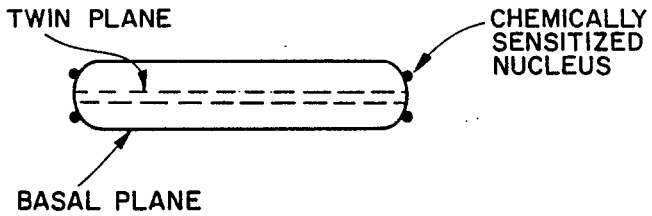

The linear ratio can be defined as b/a in FIG. 1 (*a*), but more precisely it is better to be defined as the following equation:

$$\frac{\text{Total length of the linear portion in the substantially circular tabular grain}}{\text{Total length of the extrapolated hexagonal tabular grain}} = \frac{b+d+f+h+j+l}{a+c+e+g+i+k}$$

The silver halide emulsion of the present invention comprises a binder and silver halide grains, wherein the projected area of substantially circular tabular silver halide grains having two parallel hexagonal twin planes having the linear ratio of 4/5 or less accounts for at least 70%, preferably at least 80%, more preferably at least 90%, of the projected area of the whole silver halide grains.

The substantially circular tabular grains in the present invention have the characteristic of having two parallel twin planes to the basal plane, which can be confirmed by viewing a thin cut piece of the section of a photographic film coated with the emulsion by a transmission type electron microscope at low temperatures (e.g., the temperature of liquid nitrogen or liquid helium).

The composition of the circular tabular silver halide grains in the present invention may be silver bromide, silver iodobromide, silver chlorobromide, or silver chloroiodobromide, but is preferably silver bromide or silver iodobromide. In grains containing silver iodide, the content is from 0 mol% to the solubility limit, and preferably up to about 30 mol%.

The crystal structure may be uniform in halogen composition throughout the grain, may differ in halogen composition between the inside and the outside thereof, of may have a layer structure. The change of the halogen composition between the layers may be any of a gradually increasing type, a gradually decreasing type or an abruptly changing type, which may be selected depending on the purpose, as disclosed in JP-A-63-92942 and Japanese Patent Application No. 63-88376.

In addition, it is preferred that the grains contain reduction sensitized silver nuclei. Whether the reduction sensitized silver nuclei are present or not can easily be judged by the observation of reversed images with internal fog present, when the emulsion is exposed, subjected to internal development by a conventional method, and used to draw the H-D curve as described in Japanese Patent Application No. 63-84664.

Further, the substantially circular tabular grains according to the present invention have a (100) plane at the rounded edge portions, and the ratio of (100) area/(111) area is preferably from 1/20 to 1/4. The ratio can be determined in accordance with the method disclosed by T. Tani, *Journal of Image Science,* vol. 29, p. 165 (1985).

Further, it is desirable that the chemically sensitized nuclei in the substantially circular tabular grains according to the present invention restricted preferentially to the edge portions. It is more preferred that the nuclei are restricted only to the corner portions at the rounded edges, among the edges, of the hexagonal tabular grains as shown in FIG. 1, because the position and the number of the chemically sensitized nuclei are further restricted to prevent the dispersion of latent images.

Whether the chemically sensitized nuclei are formed preferentially at the edge portions or not can be confirmed by exposing the emulsion coating and then applying arrested development in accordance with the method of D. C. Birch et al., *Journal of Photographic Science,* vol. 23, pp. 249–256 (1975) or the gelatin inclusion method described in *Journal of Applied Physics,* vol. 24, p. 1495 (1953), or the method of J.F. Hamilton et al., *Journal of Applied Physics,* vol. 27, p 874 (1956), and then observing the grains under electron microscope In this case, the number of developed nuclei formed on the edge portions relative to the number of developed nuclei formed on the two (111) basal planes of the tabular grains (hereinafter referred to as the "sensitization ratio") is not less than 2.5.

The chemically sensitized nuclei herein include sulfur sensitized nuclei, selenium sensitized nuclei, tellurium sensitized nuclei, gold sensitized nuclei and the sensitized nuclei of the noble metal in the VIII group of the periodic table and combination thereof, and most preferably gold-sulfur sensitized nuclei.

Exposure means one-second exposure and the exposure level is suitable from 1.0 time to 5 times of the minimum level which cause maximum density level.

Also, the substantially circular tabular grains in the present invention are not required to contain AgI nuclei in the grains since it is unnecessary to use AgI nuclei as the seed crystal as the case of JP-A-52-153428.

The production process for the silver halide emulsion of the present invention is further explained below.

That is, the silver halide emulsion having the substantially circular tabular grains is prepared by: forming a nucleus for silver halide grains-first Ostwald ripening; nucleus forming-first Ostwald ripening-grain growing; or nucleus forming-first Ostwald ripening-grain growing-second Ostwald ripening.

For the nucleus forming, first Ostwald ripening and grain growing steps, see the description in JP-A-63-11928, JP-A-63-92942, and Japanese Patent Application Nos. 61-299155, 62-319740 and 63-84664.

(1) Nucleation

The nucleus formation is performed by adding an aqueous solution of a water-soluble silver salt and an aqueous solution of an alkali halide to an aqueous solution containing a dispersion medium (a binder) while keeping pBr at 1.0 to 2.5.

The substantially circular tabular grains in the present invention have two parallel twin planes therein and also the silver halide emulsion of the present invention has the feature that the projected area of substantially circular tabular grains accounts for at least 70% of the projected area of the whole silver halide grains. This can be attained by controlling supersaturation factors during the formation of the twin planes in the nucleus formation conditions. The frequency of forming the twin planes during the nucleus formation depends upon various supersaturation factors (the temperature at the nucleus formation, the gelatin concentration, the addition rates of an aqueous silver salt solution and an aqueous alkali halide solution, the concentration of $Br^-$, the rate of stirring, the content of $I^-$ in the aqueous alkali halide solution added, the amount of a silver halide solvent, pH, the concentrations of salts (potassium nitrate, sodium nitrate, etc.), etc.) and the dependence thereof is illustrated by the drawings of Japanese Patent Application No. 61-238808. Practically, based on viewing such figures, these various supersaturation factors are controlled so that the probability of forming two twin planes in parallel per grain during the nucleus formation is increased and the shape of the finally formed silver halide grains is in the condition range of the silver halide emulsion of the present invention. More practically, while observing the replica images of the finally formed silver halide grains by a transmission type electron microscope, the conditions of the aforesaid supersaturation factors at the nucleus formation may be controlled.

The silver halide grains shown in the example of French Patent No. 2,534,036 has a high proportion of triangular tabular grains (tabular grains having 3 parallel twin planes) and this is considered to be caused by the employment of high supersaturation conditions during the nucleus formation.

Preferred conditions for the nucleus formation are as follows.

The dispersion medium is gelatin and gelatin is modified gelatin such as alkali-processed gelatin acid-processed gelatin, low molecular weight gelatin (having molecular weight of from 1,000 to 100,000) phthalated gelatin, hydrogen peroxide-processed gelatin, etc.

The concentration of gelatin is from 0.05 to 10% by weight, and preferably from 0.05 to 1.6% by weight.

In general, an aqueous gelatin solution has a gelatin concentration of from 2.0 to 10% by weight. The desired temperature is from 5 to 48° C. and, preferably, from 15 to 39° C. pBr is preferably from 1.0 to 2.5.

The content of $I^-$ which is initially present in an aqueous solution to be added is preferably up to 0.03 mol/liter. Also, the addition rate of silver nitrate is preferably from 0.5 g/min. to 30 g/min. per liter of the reaction aqueous solution.

As to the composition of an aqueous alkali halide solution added, it is preferred that the content of $I^-$ is at most the solid solubility limit of AgBrI, particularly up to 15 mol%.

The concentration of unrelated salts such as $KNO_3$ and $NaNO_3$ in the reaction solution is preferably from 0 to 1 mol/liter. The pH of the reaction solution may be from 2 to 10, but in the case of introducing reduction sensitizing silver nuclei, the pH is preferably from 8.0 to 9.5.

Also, the concentration of a silver halide solvent in the reaction solution is preferably from 0 to $1.5\times10^{-1}$ mol/liter. Examples of the silver halide solvent which can be used in the present invention will be described further hereinafter.

Under the conditions as described above, if nucleus formation is conducted at a temperature from 15 to 39° C. with the gelatin concentration from 0.05 to 1.6% by weight, it is more preferred since nucleus formation can be conducted for the fine grains at uniform grain size distribution.

The other important nucleating condition is as follows.

The shorter nucleation period under the higher-supersaturated condition is preferable to produce the tabular grains whose interval between the two parallel twin planes is shorter, and the longer nucleation period under the lower-supersaturated condition is preferable to produce the tabular grains whose interval between the two parallel twin planes is longer. The nucleation period is ranged normally from 10 seconds to 10 minutes. The shorter interval tabular nuclei are preferable to produce the thinner tabular grains, because it is impossible to produce the thinner tabular grains than the interval between the two parallel twin planes.

(2) Ripening

In the nucleus formation described above in (1) fine tabular grain nuclei are formed and at the same time many other fine grains (in particular, octahedral and single twin grains) are formed. It is necessary to extinguish grains other than tabular grain nuclei before entering the growing step described below, in order to provide nuclei having shapes suitable for forming tabular grains and good monodispersiblity In the ripening process, the fine octahedral grains and the single twin fine grains are dissolved and deposited on the tabular nuclei, whereby the existing ratio of tabular grains is increased.

As the ripening process in the present invention, the following processes are preferred.

(1) After the formation of nuclei, the concentration of gelatin and the value of pBr are controlled, then the temperature of the system is increased, and ripening is performed until the proportion of the hexagonal tabular grains is maximized.

(2) After the formation of nuclei, the concentration of gelatin and the value of pBr are controlled, the temperature of the system is increased, an aqueous silver nitrate solution only or both an aqueous silver nitrate solution and an aqueous alkali halide solution are added to the reaction solution at a rate so as not to form new nuclei to selectively grow tabular grains, and after further stabilizing the tabular grains to provide discrimination in stability between the tabular grains to be grown and other grains to be extinguished, ripening is performed until the proportion of the tabular grains is maximized.

(3) After the formation of nuclei, the concentration of gelatin and the value of pBr are controlled, the temperature of the system is increased and while adding an aqueous silver nitrate solution and an aqueous alkali halide solution to the reaction solution at a rate of from 0 to 10%, preferably from 0 to 3% of the critical growing rate, ripening is performed until the proportion of the tabular grains is maximized.

The state wherein the proportion of tabular grains is maximized can be practically determined by changing the ripening time and viewing the replica images of finally obtained grains by a transmission type electron microscope. If ripening is performed excessively, the proportion of the tabular grains generally tends to decrease and the grain size distribution becomes broad.

(4) After the formation of nuclei, the concentration of gelatin is adjusted, the temperature of the system is increased, and ripening is performed while adding an aqueous silver nitrate solution In this case, the addition of the aqueous silver nitrate solution has a function of neutralizing excess $Br^-$ used during the formation of nuclei to control the value of pBr for the subsequent growing step and a function of efficiently performing the ripening step. In this case, the addition rate of silver nitrate is generally from 0 to 10 % of the critical growing rate until the proportion of the tabular grains is maximized.

The growing under low supersaturation in the steps (3) and (4) simultaneusly causes so-called Ostwald ripening and slow growing of grains, which can effectively perform the ripening step. Particularly, in the case of conducting the nucleus formation with AgBrI at high iodine content, the next ripening for increasing the tabular grain ratio is extremely slow in the ripening rate, but if the ripening is conducted while adding $AgNO_3$ and KBr at low rate, the ripening is more effectively promoted.

Preferred conditions at ripening in the afore-said steps (1) to (4) are as follows.

The ripening temperature is from 40° C. to 80° C., preferably from 50° C. to 80° C. The concentration of gelatin is from 0.05 to 10% by weight, preferably from 1.0 to 5.0% by weight. The concentration of a silver halide solvent is from 0 to 0.4 mol/liter, preferably from 0 to 0.1 mol/liter. Examples of the silver halide solvent for use in this case are described hereafter. Also, the value of pBr is generally from 1.2 to 2.5, and preferably from 1.3 to 2.2.

Although the substantially circular tabular grains according to the present invention can be used immediately after the ripening has been completed, the following crystal growth is usually conducted for improving the monodispersibility further and enlarging the size of the grains to a desired grain size.

(3) Growing

In the crystal growing period after the ripening step, the pBr is preferably maintained at 1.8–3.5. Further, it is preferred that the addition rate of silver ions and halogen ions in the crystal growing period is from 20 to 100 %, preferably, from 30 to 100 % of the critical crystal growing rate.

In this case, if the crystals are grown under the low $Br^-$ concentration described above, the grain size distribution is narrowed and, if the crystals are grown at a lower $Br^-$ concentration and higher supersaturation, the grain size distribution is further narrowed.

As the extent of the supersaturation is increased, the grain size distribution of the formed grains is narrowed. The addition rates of the silver ions and halogen ions are increased during the crystal growth and, for the increasing method, as described in JP A-55-142329 and Japanese Patent Application No. 61-299155.

The iodine content of the silver halide laminated over the nucleus in the growing period is preferably from 0 mol% to the solid solubility limit concentration.

Furthermore, as the method of supplying iodine ions in the crystal growing period, a method of adding an emulsion of fine grain AgI previously prepared (with a grain size of not more than 0.1 μm, preferably, not more than 0.06 μm) may be used, or a method of supplying an aqueous solution of alkali halide may be used in combination. In this case, since fine AgI grains are dissolved and $I^-$ is supplied, $I^-$ is supplied uniformly which is particularly preferred to obtain uniform halogen distribution in a grain and between the grains. As the emulsion of fine grain AgX, of course, AgBr, AgBrI, AgBrCl, AgBrClI and AgCl fine grain emulsions, ad discribed in JP-A-55-142329, JP-A-58-113926 and JP-A-62-99751 may also be used.

Gradually increasing or decreasing iodine distribution in the grains can be obtained by gradually increasing or gradually decreasing the composition ratio of iodide in the halide added during the crystal growth, and an abrupt distribution can be obtained by abruptly increasing or decreasing the composition ratio of the iodide in the halide added during the crystal growth.

In the present invention, it is preferred to provide a reduction sensitized nucleus in the silver halide grains as described in JP-A-63-92942 and, in view of the above, the solution pH in the growing stage is preferably from 8.0 to 9.5.

(4) Second ripening

At the stage upon completion of the growing period, the shape is usually a hexagonal tabular form as described in Japanese Patent Application No. 61-299155.

Then, the substantially circular tabular grains according to the present invention can be obtained by a second ripening of the emulsion.

As the ripening conditions, ripening is preferably conducted under the following conditions.

The temperature is from 40 to 80° C., preferably, from 50 to 80° C., the ripening time is from 10 to 100 min, preferably, from 20 to 60 min, the gelatin concentration is from 0.05 to 10 % by weight, preferably, from 1.0 to 5% by weight, the concentration of the silver halide solvent is from 0 to 0.4 mol/l, preferably, from $10^{-4}$ to 0.1 mol/l and the type of the silver halide solvent described later may be used. The pBr is from 1.8 to 3.5, preferably, from 2.0 to 3.0. Particularly, when ripening is conducted at low pAg conditions, the tabular grains are dissolved generally at the edges thereof and dissolved portions are deposited on the basal plane of the tabular grains. That is, the aspect ratio is decreased, accompanying the dissolution of the edge and formation of a circular shape. This is caused, because the equilibrium crystal habit at equilibrium condition is the (100) plane at the low pAg condition and the configuration also tends to shift to the equilibrium condition.

The extent to which the edges of hexagonal tabular grains become circular is dependent on the temperature upon second ripening, pBr value, and the type and the concentration of the silver halide solvent used. Specifically, the conditions can be set by varying the ripening conditions and observing the obtained grains as electromicroscopic photographic images. Usually, as the concentration of the silver halide solvent is increased, a rounding tendency is promoted, while the rounding is restrained as $Br^-$ concentration is increased. Specifically, the circular tabular grains according to the present invention are obtained on the hatched side of the curve shown in FIG. 8 in Example 5, and hexagonal tabular grains as described in Japanese Patent Application No. 61-29915 are obtained on the side of the white area.

The second ripening step also has an effect of reducing the small amount of non-tabular fine grains remaining after the formation of the hexagonal tabular grains.

As another method for preparing the substantially circular tabular grains according to the present invention, hexagonal tabular grains are at first prepared, which are then grown at a low pAg and in the presence of a silver halide solvent described later under low-saturation conditions, and edge portions are rounded to reveal a (100) plane at the edge portions.

The low pAg condition is from about 1.8 to 4, preferably, from about 2.0 to 3.5 pBr, and the low saturation degree is from 0 to 40% of the critical crystal growing rate of the emulsion thereof. Further, from 0 mol/l to $10^{-1}$ mol/l of the concentration is preferred for the silver halide solvent.

After forming the circular tabular grains in this way, and successively adsorbing the adsorbent (sensitizing dye, anti-fogging agent, stabilizer), they are ripened by adding sulfur.

In this case, it is necessary to select the type of the sulfur sensitized nuclei and ripening conditions for preferentially forming sulfur sensitized nuclei on the (100) plane rather than the (111) plane.

For instance, if the conditions of ripening for the emulsion are:pH 6.5, pAg 8.5, 50° C. and 60 min, triethylthiourea reacts highly selectively on the (100) plane as compared with the (111) plane to selectively form sulfur sensitized nuclei on the (100) plane. However, since the selective reactivity is low under other conditions, for example, ripening at pH 6.5, pAg 8.5, 65° C., 60 min or ripening under pH 6.5, pAg 7.7, 50° C., 60 min, these are not desirable. The plane selectivity is generally increased under high pAg conditions including the case of other sulfur sensitizers. Further, the use of plane selective adsorbents showing selective adsorption to the (111) plane is more preferred since the selective formation of chemical sensitized nuclei on the (100) plane is accelerated.

Other chemical sensitizing method for the silver halide emulsion of the present invention is described in, for example, Japanese Patent Application No. 61-299155, 62-219982, 62-319740, 63-26979 and 63-84664, and JP-A-58-113926.

While the silver halide grains according to the present invention can be used by themselves for an emulsion, the grains may be used for forming a core-shell type direct reversal emulsion by using the grains as the core, as described in Example 13 in Japanese Patent Application No. 61-299155 and U.S. Pat. Nos. 3,761,276, 4,269,972 and 3,367,778.

Further, the tabular grains can be used as the core for forming the internal latent type emulsion as described in JP-A-59-133542 and U.S. Pat. Nos. 3,206,313 and 3,317,322.

Further, the tabular grains may be used as the host grains for forming epitaxial grains, as described in JP-A-58-108526, JP-A 57-133540 and JP-A-62-32443.

Further, the tabular grains may be used as substrate grains for forming ruffled grains, as described In U.S. Pat. No. 4,643,966.

Furthermore, the tabular grains may be used as the core for forming grains having dislocation lines in the inside, as described in Japanese Patent Application No. 62-54640.

The tabular grains can also be used in the high hardening film system, discussed in JP-A-58-113926 and *Research Disclosure,* vol. 184, Item 18431, K (August, 1979).

It is also possible to use a method of adding an oxidizing agent such as $H_2O_2$ or a peroxy acid until the completion of the ripening for gold sensitization and then adding a reducing substance, or a method of decreasing free gold ions in the light-sensitive material after the ripening for gold sensitization, as disclosed in JP-A-61-3134, JP-A-61-3136, JP-A-61-219948, JP-A-61-219949, and Japanese Patent Application Nos. 60-96237, 61-184890 and 61-183949. The tabular grains may be spectrally sensitized by an antenna dye, as disclosed in JP-A-62-209532 and Japanese Patent Application Nos. 61-284271 and 61-284272.

The tabular grain emulsion according to the present invention may be used as a substrate, on which silver halide layers of different halogen compositions may be laminated on the basal planes of the tabular grains as disclosed in Japanese Patent Application No. 61-253371 to in this regard. In this case, an AgBrI (iodine content of from 0 to 30 mol%, preferably) and an AgBrCl (chlorine content of from 0 to 90 mol%) is preferred as the silver halide layer to be laminated.

For the utilization of light interference for the tabular grains, see Japanese Patent Application No. 61-299155. The tabular grain emulsion of the present invention can be used for light-sensitive materials, as described in Example 9 in Japanese Patent Application No. 62-203635, Japanese Patent Application No. 61-109773, Japanese Patent Application No 62-54640, Example 12 of Japanese Patent Application No. 61-299155, Japanese Patent Application No. 62-263319, Example 1 of JP-A-62-269958 and JP-A-62-141112.

In the step of forming nuclei in the present invention, a silver halide solvent may be used for controlling the super-saturation conditions that determine the frequency of forming twin planes.

Further, in the ripening step of the present invention, a silver halide solvent may be used for accelerating the ripening and also accelerating the crystal growth in the crystal growing stage after the ripening.

Silver halide solvents often used include thiocyanates, ammonia, thioether, thioureas, anti-fogging agents, and stabilizers.

For instance, there can be used thiocyanates as described in, for example, U.S. Pat. Nos. 2,222,264, 2,448,534 and 3,320,069, ammonia, thioether compounds as described in, for example, U.S. Pat. Nos. 3,271,157, 3,574,628, 3,704,130, 4,297,439 and 4,276,347, thione compounds as described in, for example, JP-A-53-144319, JP-A-53-82408 and JP-A-55-77737, and amine compounds as described in, for example, JP-A-54-100717.

There is no particular restriction for other ingredients (that is, additives, doping agents, sensitizers, constitution of the light-sensitive materials, development process, etc.) of the emulsion and the emulsion layer used for the silver halide photographic light-sensitive material according to the present invention.

Any combination of known additives and techniques as disclosed in, for example, *Research Disclosure,* vol. 176 (Item 17443) (December, 1978), *Research Disclosure,* vol. 184 (Item 18431) (August, 1979), *Research Disclosure,* vol. 134 (Item 13452) (June, 1975), *The Journal of Product Licensing Index,* vol. 92, pp. 107–110 (December, 1971), *Monthly Report of Japanese Chemical*

*Society,* (NIKKA-KYO GEPPO) (December, 1984), pp. 18–27, JP-A-58-113926, JP-A-58-113927, JP-A-58-113928, JP-A-59-90842, JP-A-63-151618, JP-A-61-3134, JP-A-62-62-115035 JP-A-62-6251, JP-A-62-160449, JP-A-62-141112, and JP-A-62-269958, Japanese Patent Application Nos. 62-219982, 63-84664, 62-319740, 61-109773, 62-54640 and 62-263319, U.S. Pat. Nos. 4,705,744 and 4,707,436, T.H. James, *The Theory of The Photographic Process,* Fourth Edition, Macmillan, (New York, 1977), V.L. Zelikman et al, *Making and Coating Photographic Emulsion* (The Focal Press, 1964), P. Glafkides, *Chimie et Physique Photographiques,* Fifth Edition, Edition de l'Usine Nouvelle, (Paris, 1987), and *Chimie et Physique Photographiques,* Second Edition, Paul Montel, (Paris, 1957), can be sed.

The more detail expression of the ingredients is as follows A chemical sensitizer, spectral sensitizer, anti-fogging agent, metal ion dope, silver halide solvent, stabilizer, dye, color coupler, DIR coupler, binder, film hardener, fogging agent, coating aid, viscosity improver, emulsion flocculation agent, plasticizer, dimensional stability improver, antistatic agent, fluorescent brightener, lubricant, matting agent, surface active agent, UV-absorber, scattering or absorbing material, hardener, adhesion inhibitor, photographic property improver (for example, development accelerator and tone hardener), coupler releasing photographically useful ingredients such as a developer (development restrainer or accelerator, bleaching accelerator, developer, silver halide solvent, toner, film-hardener, anti-fogging agent, competitive coupler, chemical or spectral sensitizer and desensitizer), dye image stabilizer, self-inhibiting developer. The methods of using various additions effects of super sensitization in spectral sensitization, halogen acceptor effect and electron acceptor effect of spectral sensitizing dye, effects of anti-fogging agents, stabilizers, development accelerators or restrainers and, in addition, production devices, reaction devices, agitation devices, coating methods, drying methods and exposure methods (light source, exposure atmosphere, exposure method) as well as photographic supports, microcellous supports, under coating layers, surface protection layers, intermediate layers, anti-halation layers, photographic processing agents, photographic processing methods, layer arrangement of multi-layered light-sensitive materials, color image-forming methods, methods for chemical sensitization, applications to multi color photographic materials, etc.

The relevant descriptions contained in the *Research Disclosures* are shown below.

| Type of additives | RD 17643 | RD 18716 |
|---|---|---|
| (1) Chemical sensitizer | p 23 | p 67 right col. |
| (2) Sensitivity improver | | " |
| (3) Spectral sensitizer, Super sensitizer | p 23–24 | p 648, right col.–p 649 right col. |
| (4) Brightener | p 24 | |
| (5) Anti-fogging agent, Stabilizer | p 24–25 | p 649, right col. |
| (6) Light absorber, Filter dye, UV absorber. | p 25–26 | p 649, right col.–p 650, left col. |
| (7) Stain inhibitor | p 25 right col. | p 650, left-right col. |
| (8) Dye image stabilizer | p 25 | |
| (9) Film hardener | p 26 | p 651, left col. |
| (10) Binder | p 26 | " |
| (11) Plasticizer, lubricant | p 27 | p 650, right col. |

-continued

| Type of additives | RD 17643 | RD 18716 |
|---|---|---|
| (12) Coating aid, Surface active agent | p 26–27 | " |
| (13) Antistatic agent | p 27 | " |

In the present invention, various color couplers can be used and specific examples are shown in the patent publications described in *Research Disclosure,* No. 17643, VII-C-G described above.

Preferred yellow couplers are described, for example, in U.S. Pat. Nos. 3,933,501, 4,022,620, 4,326,024 and 4,401,752, JP-B-58-10739 (the term "JP-B" as used herein means an "examined Japanese Patent Publication") and British Patent Nos. 1,425,027 and 1,476,760.

5-pyrazolone type and pyrazoloazole type compounds are preferred as the magenta coupler and particularly preferred examples are described in, for example, U.S. Pat. Nos. 4,310,619 and 4,351,897, European Patent No. 73,636, U.S. Pat. Nos. 3,061,432 and 3,725,067, *Research Disclosure,* No. 24220 (June, 1984), JP-A-60-33552, *Research Disclosure,* No. 24230 (June, 1984), JP-A-60-43659, U.S. Pat. Nos. 4,500,630 and 4,540,654.

As the cyan coupler, phenol type and naphthol type couplers can be mentioned, and preferred couplers are described in, for example, U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Application (OLS) No. 3329729, EP-A- 121365, U.S. Pat. Nos. 3,446,622, 4,333,999, 1,451,559 and 4,427,767, and EP-A-161626.

Preferred colored couplers for compensating the unnecessary absorption of color forming dyes are described, for example, in *Research Disclosure,* No. 17643, Item VII-G, U.S. Pat. No. 4,163,670, JP-B-57-39413, U.S. Pat. Nos. 4,004,929 and 4,138,258 and British Patent No. 1,146,368.

As couplers in which the color forming dye has adequate diffusibility, those described in U.S. Pat. No. 4,366,237, British Patent No. 2,125,570, European Patent No. 96,570 and West German Patent Application (OLS) 3,234,533 are preferred.

Typical examples of the polymerized dye-forming coupler are described in, for example, U.S. Pat. Nos. 3,451,820, 4,080,211, and 4,367,282 and British Patent No. 2,102,173.

Couplers releasing photographically useful residues upon coupling can also be used preferably in the present invention. As DIR couplers releasing development restrainers, those disclosed in JP-A-57-151944, JP-A-57-154234, JP-A-60-184248, U.S. Pat. No. 4,248,962, and patents recited in *Research Disclosure,* RD-17643, Item VII-F are preferred.

Preferred couplers releasing nucleating agents or development accelerators imagewise upon development are described in British Patent Nos. 2,097,140 and 2,131,188, and JP-A-59-157638 and JP-A-59-170840.

Other couplers for the light-sensitive material in the present invention are competitive couplers as described in, for example, U.S. Pat. No. 4,130,427, poly-equivalent couplers as described in, for example, U.S. Pat. Nos. 4,283,472, 4,338,393 and 4,310,618, couplers releasing DIR redox compounds as described in, for example, JP-A-60-185950, dye releasing-couplers that restore color after coupling-off as described in EP-A-173302.

The coupler used in the present invention can be introduced into the light-sensitive material by various known dispersion methods.

Examples of the high boiling solvent used in the oil-in-water droplet dispersion method are described in, for example, U.S. Pat. No. 2,322,027.

Specific examples of the latex dispersion method and specific examples of the immersing latex are described in, for example, U.S. Pat. No. 4,199,363, West German Patent Application (OLS) Nos. 2,541,274 and 2,541,230.

Suitable supports usable in the present invention are described in, for example, *Research Disclosure,* No. 17643, p. 28 and No. 18716, from p. 647, right column to p. 648, left column.

The color photographic light sensitive material in accordance with the present invention can be developed by conventional methods as described in *Research Disclosure,* No. 17643, p. 28–p. 29 and No. 18716, from p. 651 left column to right column cited above.

The silver halide emulsion according to the present invention can be contained in one or more layers (for example, two or three layers) on the support if necessary together with other emulsions or protection layers, intermediate layers and filter layers. It can be provided on both sides of a support. In addition, emulsions of different color sensitivities can be used.

For the layer structure, descriptions are provided in IP-A-61-3143 and Japanese Patent Application No. 61-299155.

The silver halide emulsion according to the present invention can be used for black-and-white silver halide photographic light-sensitive materials, (e.g., X-ray light-sensitive materials, lith type light-sensitive materials, and black-and-white-photographic negative films) or color photographic light sensitive materials, (e.g., color negative films, color reversal films and color papers). Furthermore, it can be used also for diffusion transfer light-sensitive materials (for example, color diffusion transfer elements, and silver salt diffusion transfer elements), and thermal development light-sensitive materials (black and white, and color).

The color developer used for the developing treatment of the light-sensitive material according to the present invention is, preferably, an aqueous alkaline solution containing an aromatic primary amine color developing agent as the main ingredient. As the color developing agent, aminophenolic compounds are useful and p-phenylenediamine type compound is preferably used.

Typical examples thereof include, for example 3-methyl-4amino-N,N-diethylaniline, 3-methyl-4-amino-N-ethyl-N-Δ-hydroxyethylaniline, 3-methyl-4-amino-N-ethyl-N-Δ-methanesulfonamide-ethylaniline, 3-methyl-4-amino-N-ethyl-N-Δ-methoxyethylaniline and sulfates, hydrochlorides or p-toluene sulfonates thereof. One or more of these compounds may also be used in combination of two or more of them depending on the purpose.

The color developer generally contains a pH buffer such as alkali metal carbonate, borate or phosphate, development restrainer or anti-fogging agent such as bromides, iodides, benzimidazoles, benzothazoles or mercapto compounds. In addition, as typical examples, various types of preservatives such as hydroxyl amines, diethylhydroxyl amines, hydrazine sulfites, phenyl semicarbazides, triethanolamine, cathecol sulfonic acids, triethylenediamine(1,4-diazabicyclo(2,2,2)octane), organic solvents such as ethylene glycol and diethylene glycol, development accelerators such as benzyl alcohol, polyethylene glycol, quaternary ammonium salt and amines, dye-forming couplers, competitive couplers, fogging agents such as sodium boron hydride, auxiliary developing agents such as 1-phenyl-3-pyrazolidone, viscosity improvers, various kinds of cleating agents represented by aminopolycarboxylic acid, aminopolyphosphonic acid, alkyl-phosphonic acid and phosphonocarboxylic acid, for example, ethylenediamine tetraacetic acid, nitrilotriacetic acid, diethylenetriamine penetaacetic acid, cyclohexanediamine tetraacetic acid, hydroxyethylimino diacetic acid, 1-hydroxyethylidene-1,1-diphosphonic acid, nitrilo-N,N,N-trimethylenephosphonic acid, ethylenediamine N,N,N′,N′-tetramethylenephosphonic acid, ethylenediamine-di(o-hydroxyphenyl acetic acid) and salts thereof, can be used as required.

Further, in the case of applying reversal treatment, color development is conducted after conventional black-and-white development. As the black-and-white developer, known black-and-white developing agents, for example, dihydroxybenzenes such as hydroquinone, 3-pyrazolidones such as 1-phenyl-3-pyrazolidone or aminophenols such as N-methyl-p-aminophenol can be used alone or in combination.

The pH value of the color developer or black and white developer is generally from 9 to 12. The replenishing amount for the developer depends on the type of the color photographic light-sensitive material to be processed, and it is generally not more than 3 liter/$m^2$ of the light-sensitive material, which can be reduced to below 500 ml by decreasing the bromide ion concentration in the replenishing solution. In the case of reducing the replenishing amount, it is preferred to prevent the evaporation and air oxidation of the solution by decreasing the area of contact with air in the processing tank. It is also possible to reduce the replenishing amount by suppressing the accumulation of bromide ions in the developer.

The photographic emulsion layer after the color development is usually bleached. The bleaching treatment may be applied simultaneously with the fixing treatment (bleach-fixing treatment) or independently. Further for decreasing the processing time, a processing method of applying bleach-fixing after bleaching may be used. Furthermore, processing can be conducted with two successive bleach-fixing baths, fixing before bleach-fixing treatment or bleaching after bleach-fixing treatment. As the bleaching agent, polyvalent metal compounds such as ion (III), cobalt (III), chromium (VI) or copper (II), peracids, quinones and nitro compounds are used. Typical bleaching agents include ferricyanides; bichromates; organic acid salts of iron (III) or cobalt (III), for example, complex salts such as these of amino polycarboxylic acid, e.g., ethylenediamine tetraacetic acid, diethylenetriamine pentaacetic acid, cyclohexanediamine tetraacetic acid, methyliminodiacetic acid, 1,3-diaminopropane tetraacetic acid, glycol ether diamine tetraacetic acid, or citric acid, tartaric acid and malic acid; persulfates; bromic acid salts; permanganates and nitrobenzenes. Among them, complex iron (III) salts of aminopolycarboxylic acids including iron (III) complex salts of ethylenediamine tetraacetic acid and persulfates are preferred for rapid processing and for the prevention of environmental pollution. Furthermore, the complex iron (III) salt of aminopolycarboxylic acid is particularly useful for the bleaching solution and bleach-fixing solution. The pH value of the bleaching solution or bleach-fixing solution using these iron (III) salts of aminopolycarboxylic acids is usually from 5.5 to 8, but processing at lower pH is also possible for decreasing the processing time.

Bleach-accelerators can be used as required for the bleaching solution, bleach-fixing solution and preceeding bath thereof. Specific examples of useful bleach-accelerators are compounds having a mercapto group or disulfide group as described in, for example, U.S. Pat. No. 3,893,858, West German Patent Nos. 1,290,812 and 2,059,988, JP-A-53-32736, JP-A-53-57831, JP-A-53-37418, JP-A-53-72623, JP-A-53-95630, JP-A-53-95631, JP-A 53-104232, JP-A-53-124424, JP-A-53-141623, JP-A-53-28426, and *Research Disclosure,* No. 17129 (July, 1978); thiazolidine derivatives disclosed in JP-A-50-140129; thiourea derivatives disclosed in JP-B-45-8506, JP-A-52-20832 and JP-A-53-32735 and U.S. Pat. No. 3,706,561; iodide salts disclosed in West German Pat. No. 1,127,715 and JP-A-58-16235; polyoxyethyelene compounds disclosed in West German Pat. Nos. 966,410 and 2,748,430; polyamine compounds disclosed in JP-B-45-8836; compounds disclosed in JP-A-49-42434, JP-A-49-59644, JP-A-53-94927, JP-A-54-35727, JP-A-55-26506 and JP-A-58-16394, and bromide ions.

Among them, those compounds having a mercapto group or disulfide group are preferred in view of the great accelerating effect and, particularly, those compounds described in U.S. Pat. No. 3,893,858, West German Patent No. 1,290,812 and JP-A-53-95630 are preferred. Furthermore, the compounds disclosed in U.S. Pat. No. 4,552,834 are also preferred. These bleach accelerators may be added to the light-sensitive material. These bleach accelerators are particularly effective upon bleach-fixing of the photographing color light-sensitive material As the fixing agent, thiosulfates, thiocyanates, thioethers, thioureas, and a large amount of iodide salt, can be mentioned. Thiosulfate is generally used and, particularly, ammonium thiosulfate can be used. As the preservative for the bleach-fixing solution, a sulfite, a hydrogen sulfite or a carbonyl hydrogen sulfite adduct is preferred.

The silver halide color photographic light-sensitive material according to the present invention is generally processed by desilvering treatment and then with water washing and/or stabilizing step. The amount of washing water in the water washing step can be set within a wide range depending on the properties of the light-sensitive material (for example, depending on the material used such as couplers), application use, as well as temperature of washing water, number of water washing tanks, that is, number of steps, replenishing system such as countercurrent or cocurrent type and other various conditions. Among them, the relationship between the number of water washing tanks and the amount of water in the multi-stage countercurrent system can be determined by the method disclosed in *Journal of the Society of Motion Picture and Television Engineers,* vol. 64, p248–253, (May, 1955).

According to the multi-stage countercurrent system described in this article, although the amount of washing water can be reduced remarkably, there occurs a problem that bacteria propagate due to the increase of the water standing time in the tank, and resultant supernatant products are deposited on the light-sensitive material. To proven such problems in the processing of the color light-sensitive material according to the present invention, a method of reducing calcium ions and magnesium ions as described in JP-A-62-288838 is extremely effective. Furthermore, it is also possible to use isothiazolone compounds, syabendazole, and chlorine type fungicides such as chlorinated sodium isocyanurate described in JP-A-57-8542, as well as other fungicides such as benzotriazoles described in *Bacteriocide and Fungicide Chemistry* by Hiroshi Horiguchi, *Bacteriostatic, Bacteriocidal and Fungi Controlling Techniques in Microorganisms,* edited by Eisei Gijutsukai, and *Encyclopedia for Bacteria and Fungi Control,* edited by Nippon Bokin Bokabi Gakkai.

The pH value of the washing water for the processing of the light-sensitive material according to the present invention is from 4 to 9 and, preferably, from 5 to 8. The temperature for the washing water and the washing time can also be set variously depending on the properties of the light-sensitive material, application uses, etc. They are generally selected within a range from 20 sec to 10 min at 15–45° C., preferably, from 30 sec to 5 min at 25–40° C. Furthermore, the light-sensitive material according to the present invention can be processed directly with a stabilizing solution instead of water washing described above. In such stabilization, all of the known methods as disclosed in JP A-57-8543, JP-A-58-14834 and JP-A- 60-220345 can be used.

In addition, stabilizing treatment may further be applied after the water washing treatment and, as an example, a stabilizing bath containing formalin and a surface active agent, used as the final bath for photographing color light-sensitive materials can be mentioned. Various kinds of chleating agents and fungicides can be added to the stabilizing bath.

The overflow liquid from water washing and/or replenishment of a stabilizing solution can be used again in other steps such as a desilvering step.

In the silver halide color light-sensitive material according to the present invention, a color developing agent may be incorporated with the aim of simplifying and speeding up the processing. The use of various kinds of precursors for the color developing agent is preferred, including indoaniline type compounds described in, for example, U.S. Pat. No. 3,342,597, Schiff salt type compounds disclosed in U.S. Pat. No. 3,342,599, *Research Disclosure,* No. 14850 (August, 1976) and No. 15159 (November, 1976), aldole compounds disclosed in *Research Disclosure,* No. 13924 (November, 1975), metal complex salts disclosed in U.S. Pat. No. 3,719,492 and urethane compounds disclosed in JP-A-53-135628.

In the silver halide color light-sensitive material according to the present invention, various kinds of 1-phenyl-3-pyrazolidones may be incorporated with the aim of accelerating the color development. Typical compounds are described in JP-A-56-64339, JP-A-57-144547 and JP-A58-115438.

Each of the processing solutions in the present invention is used at a temperature from 10° C. to 50° C. Although a temperature from 33° C. to 38° C. is standard, it is possible to use higher temperatures for accelerating the processing and shortening the processing time or, to use lower temperatures for improving the image quality or the stability of the processing solution. Furthermore, treatment using cobalt intensification or hydrogen peroxide intensification described in West German Patent No. 2,226,770 or U.S. Pat. No. 3,674,499 may be applied for saving silver in the light-sensitive material.

The silver halide emulsion according to the present invention has the following properties.

(1) Referring to the number of the twin planes, the tabular grains have only two parallel twin planes to the basal planes, which is the minimum number required for preparing tabular grains and have no unrequired injurious twin planes. Accordingly, the grains contain few twin defects and a reduced number of internal electron traps.

(2) Grains size distribution is narrow and the emulsion is monodisperse.

(3) During hexagonal tabular grains formation, fine non-tabular grains may be formed when the first Ostward ripening is inadequate, but such non-tabular fine grains can be dissolved and decreased by subsequent second ripening.

(4) Since easily soluble edges of the tabular grains are dissolved and lost, the emulsion shows satisfactory aging stability.

(5) Since the plane other than the (111) plane (i.e., the (100) plane) is exposed where edges or corners are dissolved, and sites for forming chemically sensitized nuclei can be restricted on this plane, chemical sensitization can be conducted while preventing dispersion of latent images.

Accordingly, it is possible to provide a light-sensitive silver halide emulsion having excellent properties in sensitivity, gradation, graininess, sharpness, resolution power, covering power, image quality, storeability, stability and pressure properties of latent images.

The present invention now explained in greater detail with reference to specific examples, but the present invention is not to be construed as being limited thereto. Unless otherwise indicated, all parts, percents and ratios are by weight.

EXAMPLE 1

An aqueous solution of gelatin (1000 ml water, 7 g of deionized alkali-treated gelatin, 4.5 g of KBr, adjusted to pH 8.0 with aqueous KOH solution, pBr, 1.42) was charged in a 4 liter volume reaction vessel and, while maintaining the solution temperature at 30° C., 25 ml of an aqueous solution of $AgNO_3$ (containing 8.0 g of $AgNO_3$) and 25 ml of an aqueous solution of KBr (containing 5.8 g of KBr) were added simulataneously for one minutes (25 ml/min flow rate). Then after stirring for one minute, 700 ml of this solution was used as seed crystals, to which an aqueous solution of gelatin (containing 800 ml of water and 35 g of deionized alkali-treated gelatin, adjusted to pH 8.0) was added and the temperature was elevated to 75° C. After the elevation of the temperature, ripening was performed for 35 minutes and then CDJ (controlled double jet) addition was conducted for 10 minutes using 120 ml of an aqueous solution of $AgNO_3$ (containing 60 g of $AgNO_3$) and 120 ml of an aqueous solution of KBr (containing 45 g of KBr) at a −4 mV silver potential (to a saturated calomel electrode) and at an addition rate of 12 ml per minute of $AgNO_3$ aqueous solution.

Figure 2:
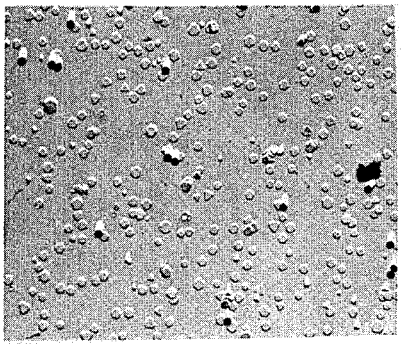
Figure 3:
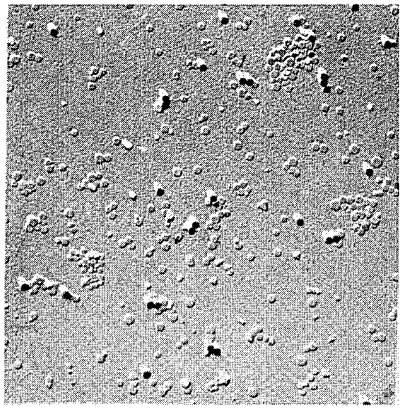

Replica images of emulsion grains after the completion of the addition were observed by a transmission type electron microscope (TEM) (×2,500). The photograph of the grains is shown in FIG. 2. The resultant grains were hexagonal tabular grains, Then, after adding an aqueous solution of $AgNO_3$ (10 wt% solution), adjusting the pBr to 3.2 and ripening for 20 minutes, the emulsion was washed with water and dispersed. Replica images of the resultant emulsion grains were observed by TEM (×2,100). The photograph of the grains is shown in FIG. 3. The properties of the emulsion grains were as described below.

| | |
|---|---|
| Projected area occupied by the grains of the present invention | 92% |
| Coefficient of variation of the grains of the present invention | 15.0% |
| Average grain size of the grains of the present invention | 0.58 μm |
| Average grain thickness of the grains of the present invention | 0.13 μm |
| Average linear ratio of the grains of the present invention | 0.4 |
| Average aspect ratio of the grains of the present invention | 4.5 |

EXAMPLE 2

Figure 4:
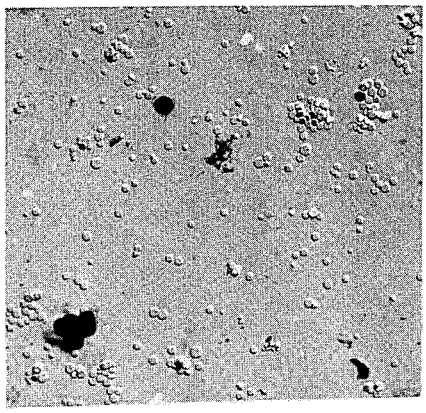

After preparing hexagonal tabular grains, adding an aqueous solution $AgNO_3$ (10 wt% solution), adjusting pBr to 3.2 and aging for 20 minutes as in Example 1, aging was continued at 75° C. for 60 minutes. Replica images of the emulsion grains obtained in this case, were observed by TEM (×2,200). A photography of the grains is shown in FIG. 4.

The properties of the emulsion grains were as described below. They showed no substantial change from those in FIG. 3 and were identical within the measuring accuracy. That is, after forming hexagonal tabular grains, the grains were changed into a circular tabular form in the initial 20 minutes ripening, but the shape of the grains showed no substantial change after the ripening for the next 60 minutes. The reason is considered that easily soluble corner portions of the hexagonal tabular grains had already been dissolved and the grains had assumed a stable configuration.

| | |
|---|---|
| Projected area occupied by the grains of the present invention | 93% |
| Coefficient of variation of the grains of the present invention | 16% |
| Average grain size of the grains of the present invention | 0.6 μm |
| Average grain thickness of the grains of the present invention | 0.135 μm |
| Average linear ratio of the grains of the present invention | 0.4 |
| Average aspect ratio of the grains of the present invention | 4.4 |

EXAMPLE 3

Seed crystals were formed in the same manner as in Example 1 except for using alkali-treated gelatin with an average molecular weight of 40,000 as the gelatin and 175 ml of the solution as seed crystals, to which an aqueous solution of gelatin containing 825 ml of water and 25 g of deionized alkali-treated gelatin and 1.28 g of KBr (adjusted pH 8.0) were added and the temperature was elevated to 75° C. After elevation of the temperature, ripening was conducted for 35 minutes, then CDJ addition was conducted by using an aqueous solution of $AgNO_3$ (containing 25 g of $AgNO_3$ per 100 ml) for 10 minutes at 6 ml/min., CDJ addition was conducted for 20 minutes at 12 ml/min. and then CDJ addition was conducted for 20 min at 20 ml/min. The CDJ potential was −4 mV in each of the cases.

An aqueous KBr solution (containing 18.5 g of KBr in 100 ml) was added as the halogen. Then, after adding an aqueous solution of $AgNO_3$ and adjusting the pBr to 2.6 and pH to 6.4, 22.2 ml of $NH_4NO_3$ (25 wt%) and 22.2 ml of $NH_3$ (12.5 wt%) were added and aged for 20 minutes. After aging, the temperature was cooled to 35° C., the product was washed with water and dispersed.

Figure 5:
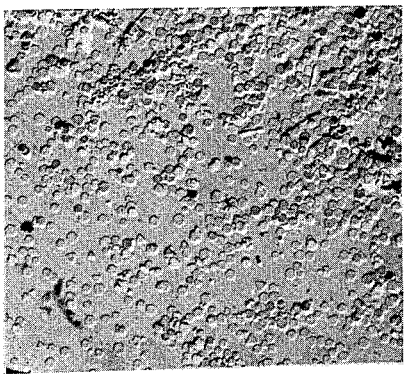

The replica image of the obtained emulsion was observed TEM by (×1,200). A photograph of the grains is shown in FIG. 5. The properties of the emulsion grains were as shown below.

| | |
|---|---|
| Projected area occupied by the grains of the present invention | 94% |
| Coefficient of variation of the grains of the present invention | 12.1% |
| Average grain size of the grains of the present invention | 1.4 μm |
| Average grain thickness of the grains of the present invention | 0.27 μm |
| Average linear ratio of the grains of the present invention | 0.75 |
| Average aspect ratio of the grains of the present invention | 5.2 |

EXAMPLE 4

An aqueous solution of gelatin (1,000 ml water, 70 g of deionized alkali-treated gelatin, 3.7 g of KBr, adjusted to pH 8.0 with aqueous KOH solution) was charged in a 4 liter volume reaction vessel and, while maintaining the solution temperature at 30° C., 25 ml of an aqueous solution of $AgNO_3$ (containing 8.0 g of $AgNO_3$) and 25 ml of an aqueous solution of halide (containing 5.65 g of KBr and 0.195 g of KI) were added simultaneously for one minute. Then after stirring for one minute, 175 ml of the solution was used as seed crystals, to which an aqueous solution of gelatin (containing 650 ml of water and 25 g of deionized alkali-treated gelatin, adjusted pH to 8.2 with 1N KOH) was added and the temperature was elevated to 75° C. After elevation of the temperature, ripening was conducted for 55 minutes and then CDJ addition was conducted at 4 ml/min. for 10 minutes by using an aqueous solution of $AgNO_3$ (containing 25 g of $AgNO_3$ in 100 ml) and an aqueous solution of a halide (containing 19.5 g of KBr and 0.7 g of KI in 100 ml), CDJ addition was conducted successively at 10 ml/min. for 30 minutes. The CDJ potential was 0 mV in each of the cases.

Figure 6:
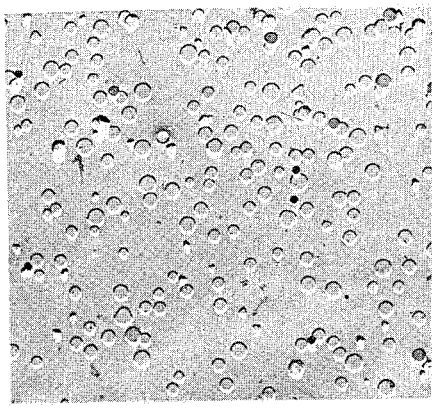
Figure 7A:
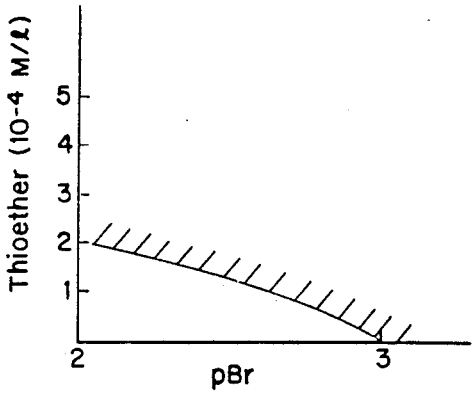
Figure 7C:
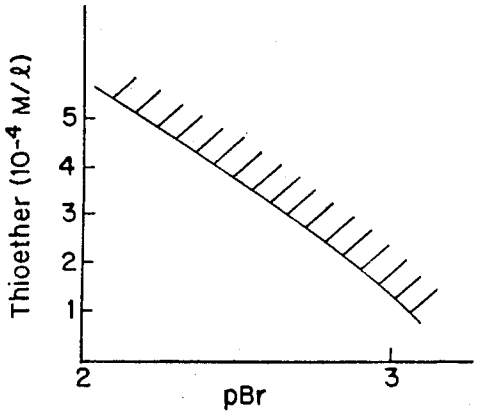
Figure 7B:
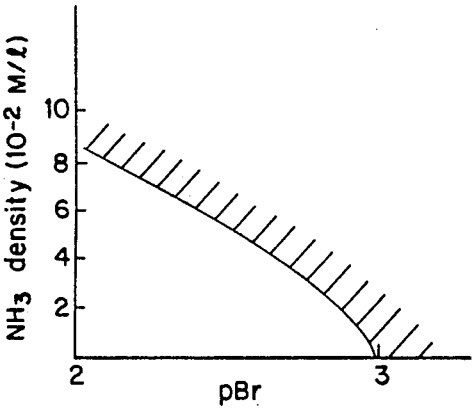
Figure 7D:
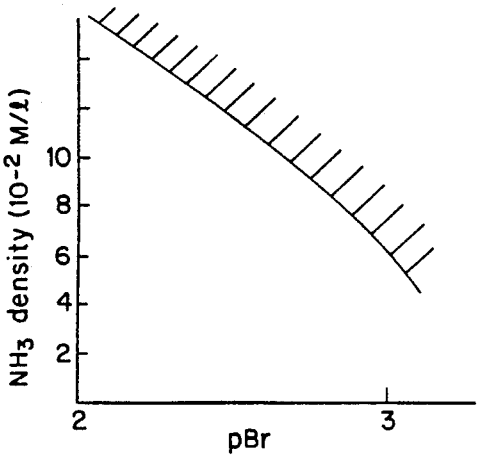

Then, after adding an aqueous solution of $AgNO_3$ (10 wt% solution), adjusting the pBr to 2.3 and pH to 6.4, it was ripened for 20 minutes by adding 2.6 ml of 5 wt% solution of 3,6-dithiaoctane-1,8-diol. The emulsion was cooled to 35° C., water washed and dispersed. Replica images of the resultant emulsion grains were observed by TEM (×4,100). The photograph of the grains is shown in FIG. 6. The properties of the emulsion grains were as described below.

| | |
|---|---|
| Projected area occupied by the grains of the present invention | 90% |
| Coefficient of variation of the grains of the present invention | 14.8% |
| Average grain thickness of the grains of the present invention | 0.19 μm |
| Average linear ratio of the grain of the present invention | 0.4 |
| Average aspect ratio of the grains of the present invention | 5.7 |
| Average grain size of the grains of the present invention | 1.06 μm |
| (100) area/(111) are for the grain of the present invention | 12% |

-continued

EXAMPLE 5

An emulsion containing small hexagonal tabular grains obtained in Example 1 and an emulsion containing hexagonal tabular grains obtained in Example 3 (pH 6.5 in each of the emulsions) were used and ripened under various conditions at 75° C. for 20 minutes while varying the pBr value for the emulsion and the addition amount of AgX solvent ($HO(CH_2)_2$-S-$(CH_2)_2$-S-$(CH_2)_2OH$ or ammonia) and TEM images of the grains were observed. The region in which the circular tabular grains of the invention were obtained is illustrated, from the result, as shown in the region on the hatched side in FIG. 7.

These results show that more silver halide solvent is required for obtaining the circular tabular grains as the grain size becomes greater or the $Br^-$ concentration becomes higher.

Further, near the boundary for the hatched portion in FIG. 7, the linear portion ratio of the circular tabular grains is increased. The aspect ratio increases and the (100) area ratio is increased further from the boundary on the hatched side. Cubic crystals are formed still further from the boundary. For instance, when ripening was applied at 75° C. for 20 minutes with pBr of 3.2 while setting $NH_3$ concentration to (1) $1.7\times10^{-2}$ M/1, (2) $6.7\times10^{-2}$ M/1, (3) $13\times10^{-2}$ M/1 and (4) $36\times10^{-2}$ M/1 in FIG. 7 (*d*), for instance, the (100) area ratio of the grains determined by the method of T. Tani as described above, it was 18% in (1), 50% in (2), 65% in (3) and 100% in (4), which was cubic crystals.

EXAMPLE 6

A methanol solution of triethyl-thiourea (0.01 wt%) ws added for 15 minutes at a steady rate in an amount of $1.5\times10^{-5}$ mol/mol of AgBr to an emulsion containing circular tabular grains obtained in Example 4 (AgX 0.5 M1, pH 6.5, pAg 8.5, temperature 50° C.) and further ripened for 50 minutes. The emulsion was washed with water at pBr 1.6 for three times and then further washed with water, redispersed and adjusted to pH 6.5 and pAg 8.5. Then, the temperature of the emulsion was elevated to 50° C., a gold sensitizer (an aqueous solution of gold-thiochyanate complex) was added to the emulsion in an amount of $0.5\times10^{-5}$ mol per mol of AgX and ripened for 60 minutes. The temperature was lowered to 35° C. and then the emulsion was coated while adding anti-fogging agent TAI (4-hydroxy-6-methyl-1,3,3a,7-tetrazaindene) and coating aids (alkylaryl-Na-sulfonate, sodium p-sulfostyrene homopolymer).

The hexagonal tabular emulsion obtained in the course of Example 4 was used as a comparative emulsion. After washing the emulsion was water, triethyl-thiourea was added momentarily and, after 3 minutes, the gold sensitizer was added with the same amount ripened at 50° C. for 60 minutes.

Both of the emulsions were exposed at an exposure amount providing the maximum density in one sec exposure, developed at 20° C. for 7 minutes using the restrained developer of Hamilton mentioned earlier, from which gelatin was removed and TEM images of the grains were observed by the replica method. Although the developing initiation points of the comparative emulsion grains were formed substantially uniformly on the surface of the grains, the development initiation point for the grains according to the present invention was formed at about 4:1 ratio in average to the edge portion of the circular tabular grains.

EXAMPLE 7

3,3'-dimethylthiazolinodicarbocyanine bromide sensitizing dye (a dye preferentially adsorbing to the (111) plane relative to (110) plane in the region from pAg 6 to pAg 10) was added in an amount equal to 70% of the saturated adsorption amount to an emulsion containing circular tabular grains obtained in Example 4 (AgX 0.5 mol/1, pH 6.5, pAg 8.0, temperature 40° C.), the pAg was adjusted to 8.0 and ripened for 20 minutes. Then, the pAg was adjusted to 8.5 and a methanol solution of triethyl-thiourea (0.005 wt%) was added in an amount of $7\times10^{-5}$ mol/mol AgBr and ripened for 60 minutes while elevating the temperature to 50° C. The emulsion was adjusted to pH 6.5 and pAg 8.5. Then, the temperature of the emulsion was elevated to 50° C. and the same gold sensitizer as in Example 1 was added in an amount of $0.3\times10^{-5}$ mol/mol AgBr and ripened for 40 minutes.

Then, the temperature was lowered to 40° C. and an anti-fogging agent and coating aid were added and the emulsion was coated on the transparent base. It was exposed at an exposure amount giving maximum density in one sec exposure, developed at 20° C. for 7 minutes by the restrained developer of Hamilton, et al, from which gelatin was removed and TEM images of grains were observed by the replica method. The development initiation point of the grains were formed at the edge portion of the circular tabular grain at an average 6:1 ratio.

EXAMPLE 8

(1) Preparation of Comparative Emulsion (1)

An aqueous solution of gelatin (1 liter of water, 3 g of gelatin and 3.7 g of KBr) was charged in a 4 liter volume reaction vessel and, while maintaining the solution temperature at 30° C., 25 ml of an aqueous solution of $AgNO_3$ (containing 8.0 g/$AgNO_3$) and 25 ml of an aqueous solution of a halide (containing 6.5 g of KBr and 0.195 g of KI) were added simultaneously for one minute. Subsequently, it was ripened and grown in the same manner as in Example 4, by which trigonal tabular grains (three twin planes) were formed into tabular grains occupying 50% of the projected area of the total grains. Second ripening was conducted under the same conditions as in Example 4 to prepare a Comparative Emulsion (1) containing circular tabular grains. The properties of the grains were 1.1 μm in average grain size, 17 % coefficient of variation for the grain size, 0.18 μm of average grain thickness and 0.4 average linear ratio.

(2) Preparation of Comparative Emulsion (2)

The emulsion washed with water with no second ripening in Example 4 was used.

Mean grain size: 1.18 μm, coefficient of variation for grain size: 16%, average grain thickness: 0.17 μm, average linear ratio 1.0, and (100) area/(111) area =0%.

The comparative emulsions (1) and (2) were chemically sensitized in the same manner as in Example 6 and an anti-fogging agent and coating aid were added.

The thus-obtained comparative emulsions (1) and (2), as well as the emulsions according to the present invention of Examples 6 and 7 were coated on a support (polyethylene terephthalate film) each in a dry silver amount of 1.5 g/m$^2$. Each of the coated specimens was exposed with wedge exposure through a blue filter for $10^{-3}$ sec and then developed with MAA-1 developer described below at 20° C. for 10 minutes.

The sensitivity and the granularity determined from the characteristic curves obtained are as shown in Table 1, and it can be seen that the emulsions according to the present invention were satisfactory in sensitivity and granularity.

MAA-1 Developer

| | |
|---|---|
| Metol | 2.5 g |
| L-Ascorbic Acid | 10.0 g |
| Nabox (product of Fuji Photo Film Co., Ltd.) | 35 g |
| Potassium Bromide | 1.0 g |
| Water | 1 liter |

TABLE 1

| | Sensitivity | R.M.S. Granularity |
|---|---|---|
| Emulsion of Example 7 | 130 | 90 |
| Emulsion of Example 6 | 120 | 90 |
| Comparative Emulsion (1) | 80 | 95 |
| Comparative Emulsion (2) | 100 | 100 |

*Sensitivity is represented by the reciprocal of the exposure amount shown by lux-sec at a concentration of 0.2 over fogging.

The R.M.S. granularity was measured by uniformly exposing the specimen at an optical amount given a density of 0.2 over fogging, applying developing treatment as described above, and then by the method as described in James, *The Theory of the Photographic Process*, p.619, (McMillan Co.) by using green filter. Each value is relative, assuming the value for the specimen using the Comparative Emulsion (2) to be 100.

EXAMPLE 9

A multi-layered color light-sensitive material containing respective layers of the composition shown below was prepared on a triacetate cellulose film support having a under coating.

Specimen 101 according to the present invention using the emulsion of the present invention (Emulsion of Example (6) and comparative specimen 102 using the Comparative Emulsion (Comparative Emulsion (2) in Example (8) were prepared for the third layer, seventh layer and eleventh layer.

Composition of the Light-Sensitive Layer

The coating amount is shown for the silver halide and colloidal silver in g/m$^2$ units of silver; for the coupler additives and gelatin by in g/m$^2$ units, and by the mol per one mol of silver halide in the same layer for the sensitizing dye.

First Layer (Anti-Halation Layer)

| | |
|---|---|
| Black colloidal silver | 0.2 |
| Gelatin | 1.3 |
| ExM-8 | 0.06 |
| UV-1 | 0.1 |
| UV-2 | 0.2 |
| Solv-1 | 0.01 |
| Solv-2 | 0.01 |

Second Layer (Intermediate Layer)

| | |
|---|---|
| Silver iodide fine grains (average grain size 0.07 μm) | 0.10 |
| Gelatin | 1.5 |
| UV-1 | 0.06 |
| UV-2 | 0.03 |
| ExC-2 | 0.02 |
| ExF-1 | 0.004 |
| Solv-1 | 0.1 |
| Solv-2 | 0.09 |

Third Layer (First Red-Sensitive Emulsion Layer)

| | |
|---|---|
| Emulsion of the present invention or Comparative Emulsion | 0.4 (silver coated amount) |
| Gelatin | 0.6 |
| ExS-1 | $1.0 \times 10^{-4}$ |
| ExS-2 | $3.0 \times 10^{-4}$ |
| ExS-3 | $1 \times 10^{-5}$ |
| ExC-3 | 0.06 |
| ExC-4 | 0.06 |
| ExC-7 | 0.04 |
| ExC-2 | 0.03 |
| Solv-1 | 0.03 |
| Solv-2 | 0.012 |

Fourth Layer (Second Red-Sensitive Emulsion Layer)

| | |
|---|---|
| Silver iodobromide emulsion (AgI: 5 mol %, internal high AgI type, diameter as sphere: 0.7 μm, coefficient of variation of diameter as sphere: 25%, regular crystal-twin crystal mixed grain, aspect ratio: 4) | 0.7 (silver coated amount) |
| Silver coated amount | 0.7 |
| Gelatin | 0.5 |
| ExS-1 | $1 \times 10^{-4}$ |
| ExS-2 | $3 \times 10^{-4}$ |
| ExS-3 | $1 \times 10^{-5}$ |
| ExC-3 | 0.24 |
| ExC-4 | 0.24 |
| ExC-7 | 0.04 |
| ExC-2 | 0.04 |
| Solv-1 | 0.15 |
| Solv-3 | 0.02 |

Fifth Layer (Second Red Sensitive Emulsion Layer)

| | |
|---|---|
| Silver iodobromide emulsion (AgI: 10 mol %, internal high AgI type, diameter as sphere: 0.8 μm, coefficient of variation of diameter as sphere: 16%, regular crystal-twin crystal mixed grain, aspect ratio: 1.3) | 1.0 (silver coated amount) |
| Gelatin | 1.0 |
| ExS-1 | $1 \times 10^{-4}$ |
| ExS-2 | $3 \times 10^{-4}$ |
| ExS-3 | $1 \times 10^{-5}$ |
| ExC-5 | 0.05 |
| ExC-6 | 0.1 |
| Solv-1 | 0.01 |
| Solv-2 | 0.05 |

Sixth Layer (Intermediate Layer)

| | |
|---|---|
| Gelatin | 1.0 |
| Cpd-1 | 0.03 |

-continued

| | |
|---|---|
| Solv-1 | 0.03 |

Seventh Layer (First Green-Sensitive Emulsion Layer)

| | |
|---|---|
| Emulsion of the present invention or comparative emulsion | 0.30 (silver coated amount) |
| Silver coated amount | 0.30 |
| ExS-4 | $5 \times 10^{-4}$ |
| ExS-6 | $0.3 \times 10^{-4}$ |
| ExS-5 | $2 \times 10^{-4}$ |
| Gelatin | 1.0 |
| ExM-9 | 0.2 |
| ExY-14 | 0.03 |
| ExM-8 | 0.03 |
| Solv-1 | 0.5 |

Eighth Layer (Second Green-Sensitive Emulsion Layer)

| | |
|---|---|
| Silver iodobromide emulsion (AgI: 4 mol %, internal high AgI type, diameter as sphere: 0.6 μm, coefficient of variation of diameter as sphere: 38%, regular crystal-twin crystal mixed grain, aspect ratio: 4) | 0.4 (silver coated amount) |
| Gelatin | 0.5 |
| ExS-4 | $5 \times 10^{-4}$ |
| ExS-5 | $2 \times 10^{-4}$ |
| ExS-6 | $0.3 \times 10^{-4}$ |
| ExM-9 | 0.25 |
| ExM-8 | 0.03 |
| ExM-10 | 0.015 |
| ExY-14 | 0.01 |
| Solv-1 | 0.2 |

Ninth Layer (Third Green-Sensitive Emulsion Layer)

| | |
|---|---|
| Silver iodobromide emulsion (AgI: 6 mol %, internal high AgI type, diameter as sphere: 1.0 μm, coefficient of variation of diameter as sphere: 80%, regular crystal-twin crystal mixed grain, aspect ratio: 1.2) | 0.85 (silver coated amount) |
| Gelatin | 1.0 |
| ExS-7 | $3.5 \times 10^{-4}$ |
| ExS-8 | $1.4 \times 10^{-4}$ |
| ExM-11 | 0.01 |
| ExM-12 | 0.03 |
| ExM-13 | 0.20 |
| ExM-8 | 0.02 |
| ExY-15 | 0.02 |
| Solv-1 | 0.20 |
| Solv-2 | 0.05 |

Tenth Layer (Yellow Filter Layer)

| | |
|---|---|
| Gelatin | 1.2 |
| Yellow colloidal silver | 0.08 |
| Cpd-2 | 0.1 |
| Solv-1 | 0.3 |

Eleventh Layer (First Blue-Sensitive Emulsion Layer)

| | |
|---|---|
| Emulsion of the invention or comparative emulsion | 0.4 (silver coated amount) |
| Silver coated amount | 0.4 |
| Gelatin | 1.0 |
| ExS-9 | $2 \times 10^{-4}$ |
| ExY-16 | 0.9 |
| ExY-14 | 0.07 |
| Solv-1 | 0.2 |

Twelfth Layer (Second Blue-Sensitive Emulsion Layer)

| | |
|---|---|
| Silver iodobromide emulsion (AgI: 10 mol %, internal high AgI type, diameter as sphere: 1.3 μm, coefficient of variation of diameter as sphere: 25%, regular crystal-twin crystal mixed grain, aspect ratio: 4.5) | 0.5 (silver coated amount) |
| Silver coated amount | 0.5 |
| Gelatin | 0.6 |
| ExS-9 | $1 \times 10^{-4}$ |
| ExY-16 | 0.25 |
| Solv-1 | 0.07 |

Thirteenth Layer (First Protective Layer)

| | |
|---|---|
| Gelatin | 0.8 |
| UV-1 | 0.1 |
| UV-2 | 0.2 |
| Solv-1 | 0.01 |
| Solv-2 | 0.01 |

Fourteenth Layer (Second Protective Layer)

| | |
|---|---|
| Silver bromide fine grains (average grain size 0.07 μm) | 0.5 |
| Gelatin | 0.45 |
| Polymethylmethacrylate grains (Diameter 1.5 μm) | 0.2 |
| H-1 | 0.4 |
| Cpd-3 | 0.5 |
| Cpd-4 | 0.5 |

In addition to the ingredients described above, a surface active agent was added as a coating aid to each of the layers. The specimen prepared as described above was referred to as specimen 101.

The chemical structural structures or chemical name of the compounds used in the present invention are shown below:

UV-1

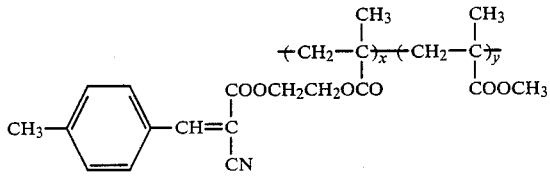

x/y = 7/3 (weight ratio)

UV-2

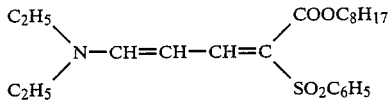

Solv-1 tricresyl phosphate
Solv-2 dibutyl phthalate
Solv-3 bis(2-ethylhexyl)phthalate ExM-8

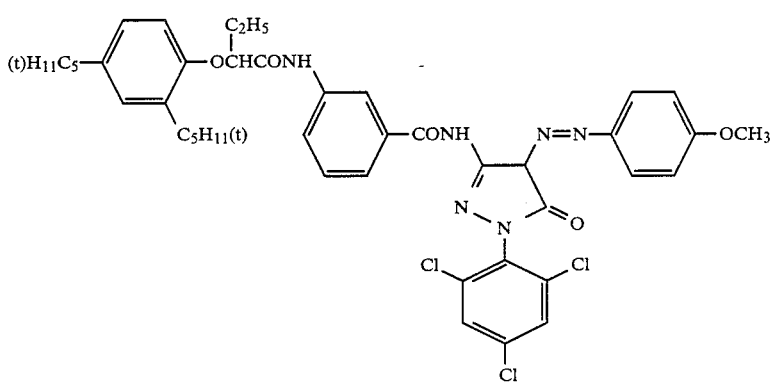

ExF-1

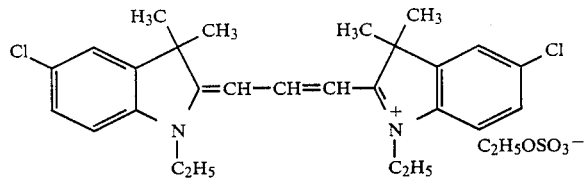

-continued
ExC-2
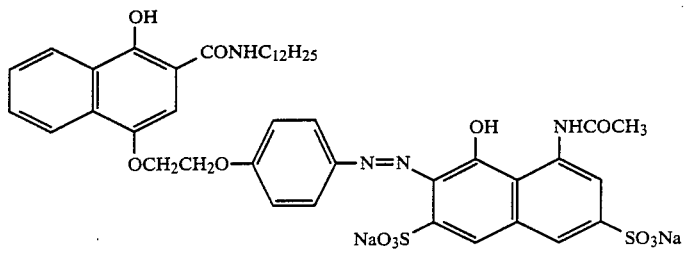
ExC-3
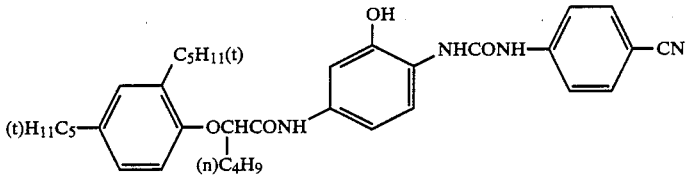
ExC-4
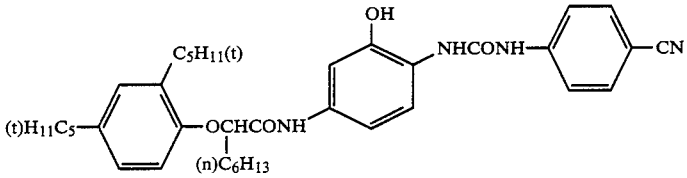
ExY-14
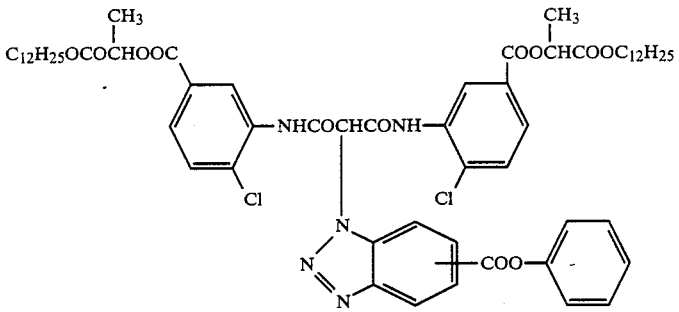
ExY-15
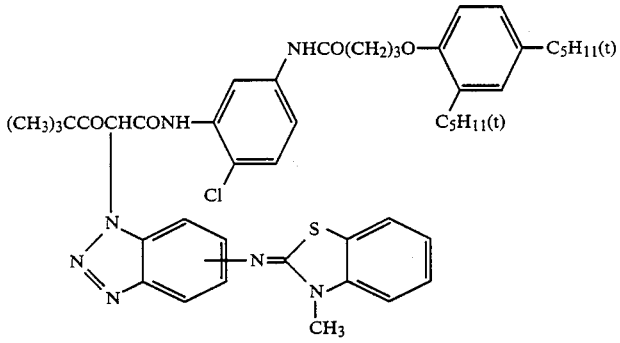

-continued
ExC-5
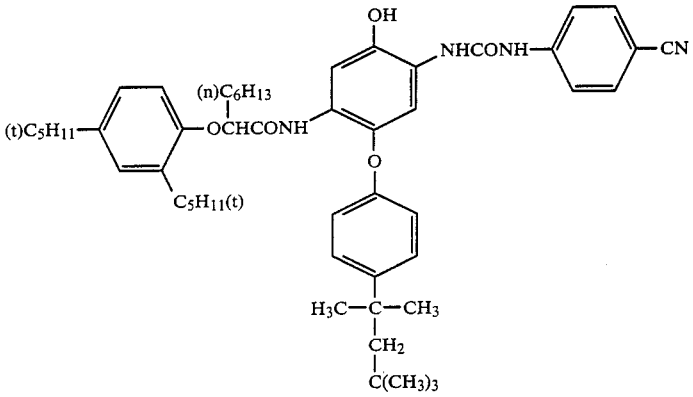
ExC-6
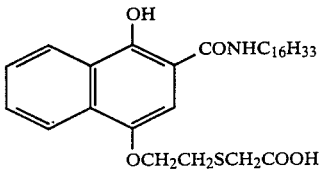
ExC-7
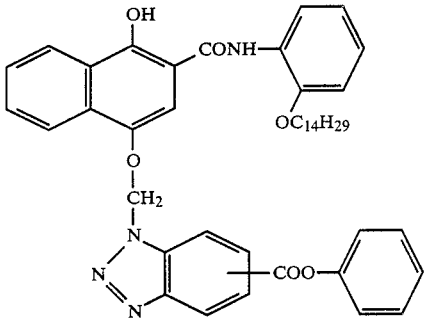
ExM-9
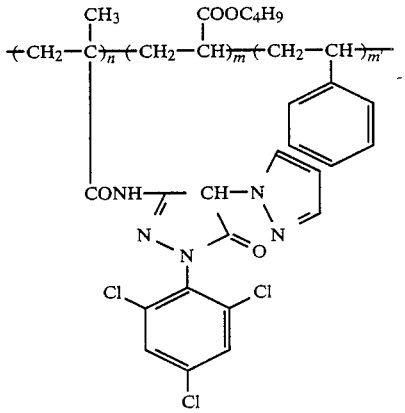
n = 50
m = 25
m' = 25
mol. wt. about 20,000

-continued
ExM-12
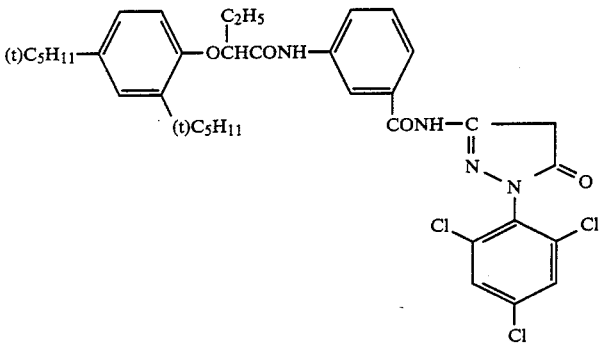
ExM-13
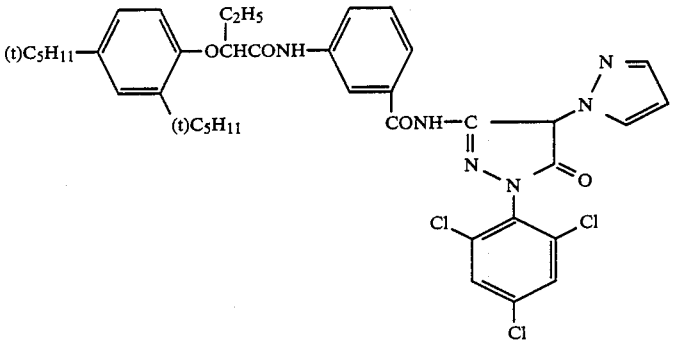
ExM-10
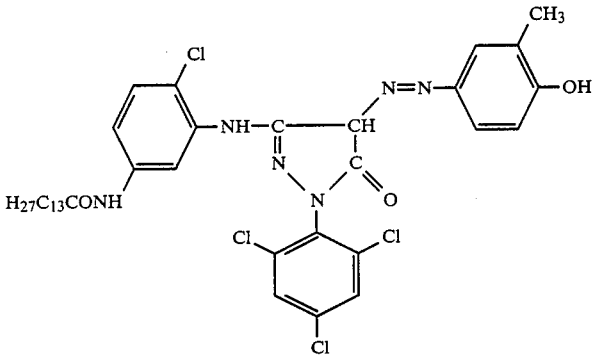
ExM-11
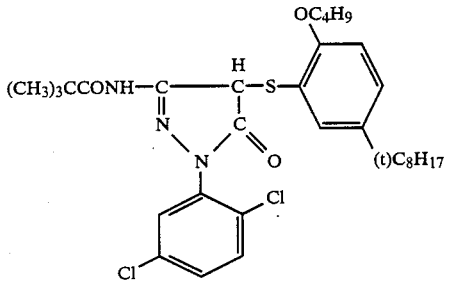
ExY-16
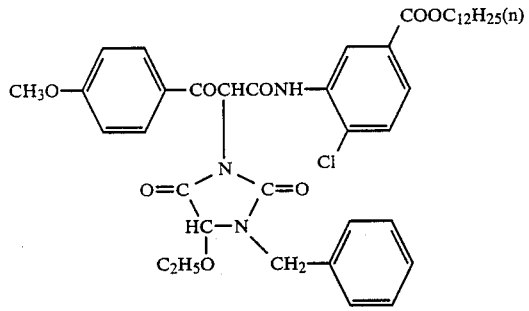

-continued
Cpd-1
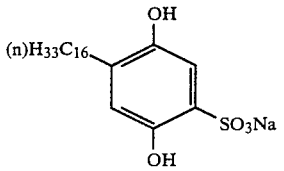
Cpd-2
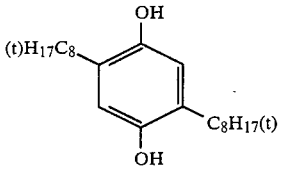
ExS-1
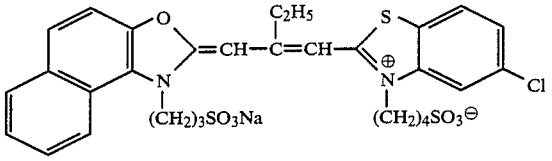
ExS-2
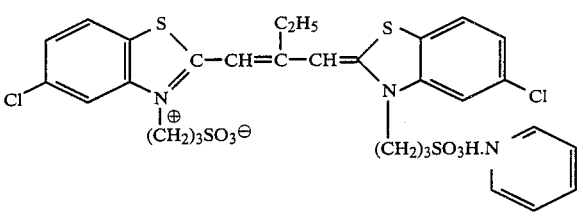
ExS-3
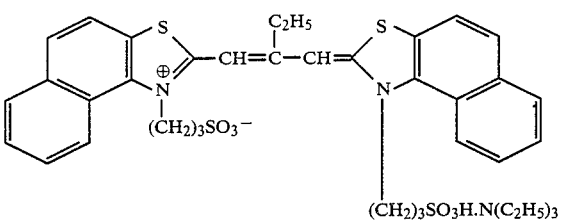
ExS-4
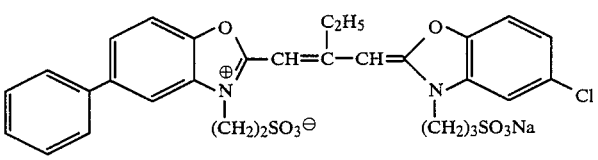
ExS-5
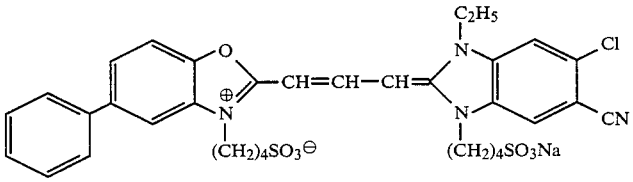
ExS-6
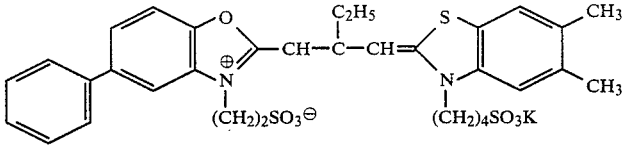

-continued

ExS-7

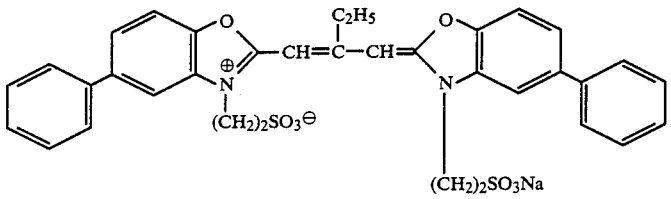

ExS-8

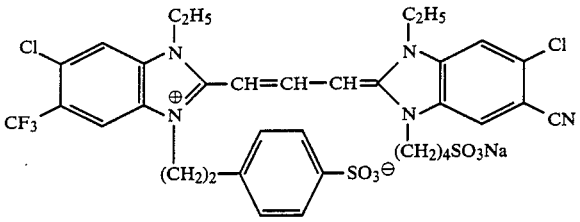

ExS-9

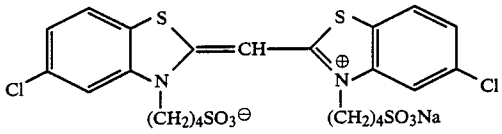

H-1

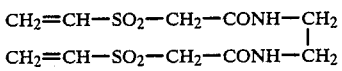

Cpd-3

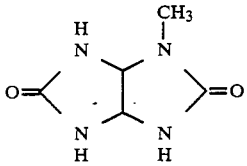

Cpd-4

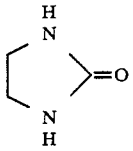

After leaving these specimens under conditions of 40° C. and 70% relative humidity for 14 hours, sensitometry exposure was applied and the following color development was conducted.

The density of the specimen after the developing treatment was measured through a green filter. The development treatment used herein was conducted under the following conditions.

| Step | Processing Time | Processing temperature |
|---|---|---|
| Color development | 3 min. 15 sec. | 38° C. |
| Bleaching | 6 min. 30 sec. | 38° C. |
| Washing | 2 min. 10 sec. | 24° C. |
| Fixing | 4 min. 20 sec. | 38° C. |
| Water washing (1) | 1 min. 05 sec. | 24° C. |
| Water washing (2) | 1 min. 00 sec. | 24° C. |
| Stabilization | 1 min. 05 sec. | 38° C. |
| Drying | 4 min. 20 sec. | 55° C. |

The compositions for the processing solution are described below:

| | (Unit: g) |
|---|---|
| (Color developer) | |

-continued

| | (Unit: g) |
|---|---|
| Diethylenetriamine pentaacetic acid | 1.0 g |
| 1-hydroxyethylidene-1, 1-di-phosphonic acid | 3.0 |
| Sodium sulfite | 4.0 |
| Potassium carbonate | 30.0 |
| Potassium bromide | 1.4 |
| Potassium iodide | 1.5 mg |
| Hydroxiyamine sulfate | 2.4 |
| 4-(N-ethyl-N-β-hydroxyethyl-amino)-2-methylaniline sulfate | 4.5 |
| Water to make: | 1.0 liter |
| pH | 10.05 |
| (Bleaching solution) | |
| Ferric sodium ethylenediamine tetraacetate 3-hydrate | 100.0 |
| Disodium ethylenediamine tetraacetate | 10.0 |
| Ammonium bromide | 140.0 |
| Ammonium nitrate | 30.0 |
| Aqueous ammonia (27%) | 6.5 ml |
| Water to make: | 1.0 |
| pH | 6.0 |
| (Fixing solution) | |
| Disodium ethylenediamine tetraacetate | 0.5 |
| Sodium sulfite | 7.0 |

-continued

| | (Unit: g) |
|---|---|
| Sodium hydrogen sulfite | 5.0 |
| Aqueous ammonium thiosulfate solution (70%) | 170.0 ml |
| Water to make: | 1.0 liter |
| pH | 6.7 |
| (Stabilizing solution) | |
| Formalin (37%) | 2.0 ml |
| Polyoxyethylene-p-monononyl phenyl ether (average polymerization degree 10) | 0.3 |
| Disodium ethylenediamine tetraacetate | 0.05 |
| Water to make: | 1.0 liter |
| pH | 5.0–8.0 |

The sensitivity is the reciprocal of the exposure amount (in lux. sec.) at a density of 0.2 over fogging.

The granularity was evaluated for these specimens.

RMS granularity was measured in the same manner as in Example 8.

TABLE 2

| | Sensitivity | Granularity (RMS) |
|---|---|---|
| Specimen 101 (the present invention) | 118 | 91 |
| Specimen 102 (Comparative) | 100 | 100 |

The values for the sensitivity and RMS in the table are relative, assuming the values for specimen 102 as 100.

As is apparent from the Table, specimen 101 according to the present invention was satisfactory in sensitivity and granularity.

While the invention has been described in detail and with reference to specific embodiments thereof, it will be apparent to one skilled in the art that various changes and modifications can be made therein without departing form the spirit and scope thereof.

What is claimed is:

1. A silver halide emulsion comprising a binder and silver halide grains, wherein the projected area of substantially circular tabular silver halide grains having two twin planes parallel to the basal planes having a linear ratio of less than or equal to 2/5 accounts for from 70% to 100% of the projected area of the whole silver halide grains, and further said substantially circular tabular silver halide grains are monodisperse grains.

2. A silver halide emulsion as in claim 1, wherein said substantially circular tabular silver halide grains have a coefficient of variation of at most 35%.

3. A silver halide emulsion as in claim 2, wherein said tabular silver halide grains have a coefficient of variation of at most 30%.

4. A silver halide emulsion as in claim 3, wherein said tabular silver halide grains have a coefficient of variation of at most 20%.

5. A silver halide emulsion as in claim 4, wherein said tabular silver halide grains have a coefficient of variation of at most 15%.

6. A silver halide emulsion as in claim 1, wherein said substantially circular tabular silver halide grains have an average aspect ratio of at least 2.5.

7. A silver halide emulsion as in claim 6, wherein said tabular silver halide grains have an average grain size of at least 0.2 μm and an average aspect ratio of from 2.5 to 20.

8. A silver halide emulsion as in claim 7, wherein said tabular silver halide grains have an average grain size of from 0.2 μm to 5 μm and an average aspect ratio of from 4 to 16.

9. A silver halide emulsion as in claim 1, wherein said substantially circular tabular silver halide grains comprise at least 80% of the total projected area of silver halide grains in said emulsion.

10. A silver halide emulsion as in claim 9, wherein said tabular silver halide grains comprise at least 90% of the total projected area of silver halide grains in said emulsion.

11. A silver halide emulsion as in claim 1, wherein said substantially circular tabular silver halide grains comprise a silver halide selected from silver bromide, silver iodobromide, silver chlorobromide and silver chloroiodobromide, the grains containing silver iodide each having from 0 to 30 mol% of silver iodide.

12. A silver halide emulsion as in claim 11, wherein said silver halide is selected from silver bromide and silver iodobromide.

13. A silver halide emulsion as in claim 1, wherein said substantially circular tabular silver halide grains have a (100) plane at the rounded edge portions of the grain and two (111) basal planes, wherein the ratio of the area of said (100) plane to said (111) planes is from 1/20 to 1/4.

14. A silver halide emulsion as in claim 13, wherein said tabular silver halide grains are preferentially chemically sensitized in said edge portions.

15. A silver halide emulsion as in claim 14, wherein the sensitization ratio of said edge portions to said two basal planes is at least 2.5.

16. A silver halide emulsion as in claim 1, wherein said substantially circular tabular silver halide grains comprise a reduction sensitized nucleus.

17. A silver halide photographic material comprising a support having thereon a silver halide emulsion comprising a binder and silver halide grains, wherein the projected area of substantially circular tabular silver halide grains having two twin planes parallel to the basal planes having a linear ratio of less than or equal to 2/5 accounts for from 70% to 100% of the projected area of the whole silver halide grains, and further said substantially circular tabular silver halide grains are monodisperse grains.

* * * * *